US007137171B2

(12) United States Patent
Meech et al.

(10) Patent No.: US 7,137,171 B2
(45) Date of Patent: Nov. 21, 2006

(54) CUSTOM ORNAMENTAL TRAVERSE RODS

(75) Inventors: Sonja R. Meech, Tucson, AZ (US); Jesus C. Galindo, Tucson, AZ (US); Ralph E. Galley, Tucson, AZ (US); Russell L. Fincher, Spring, TX (US)

(73) Assignee: Exquisite Creations For You, Inc., Tucson, AZ (US)

( * ) Notice: Subject to any disclaimer, the term of this patent is extended or adjusted under 35 U.S.C. 154(b) by 0 days.

(21) Appl. No.: 10/928,035

(22) Filed: Aug. 27, 2004

(65) Prior Publication Data

US 2005/0055800 A1 Mar. 17, 2005

Related U.S. Application Data

(60) Provisional application No. 60/498,908, filed on Aug. 29, 2003.

(51) Int. Cl.
*E05D 15/06* (2006.01)

(52) U.S. Cl. ..... 16/87.4 R; 16/87.8; 16/94 R; 16/107; 160/345

(58) Field of Classification Search ..... 16/87.4 R, 16/96 D, 97, 87.2, 87.8, 90, 91, 94 R, 102, 16/106, 107; 248/261, 262; 160/344, 345 X, 160/346, 347, 126
See application file for complete search history.

(56) References Cited

U.S. PATENT DOCUMENTS 592,795 A * 11/1897 Leslie ..... 16/89
1,662,928 A * 3/1928 Kirsch ..... 160/345
2,683,890 A * 7/1954 Rosenbaum ..... 16/87.4 R
3,119,442 A * 1/1964 Ford et al. ..... 160/345
3,370,819 A * 2/1968 Kenney ..... 248/265

(Continued)

OTHER PUBLICATIONS

Catalog: Decorative Hardware. Stroheim & Romann, JAB Anstoetz.

(Continued)

*Primary Examiner*—Brian E. Glessner
*Assistant Examiner*—Mark Williams
(74) *Attorney, Agent, or Firm*—Lawrence R. Oremland, P.C.

(57) ABSTRACT

A new and useful traverse rod structure, designed to maintain or improve the functionality of a traverse rod, while improving the aesthetics of the traverse rod is provided. The traverse rod is designed to improve the functionality of the rod, while minimizing the risk of damaging the aesthetic features of the traverse rod as the hanging object is manipulated. Still further, the traverse rod is designed with an attractive and aesthetic external appearance. In addition, the traverse rod is designed to be efficient to assemble and operate. In its preferred form, a traverse rod comprises (a) a longitudinally extending tube having an opening extending along the tube, (b) a longitudinally extending track located within the tube, the track comprising a pair of substantially co-planar track sections with a gap therebetween, and (c) one or more moveable carriers each of which is configured to engage a wall covering. Each moveable carrier has a follower extending through the opening in the tube. The follower has a first portion located at least partially in the gap in the pair of track sections and engaging the pair of substantially co-planar track sections such that the follower can ride along the track, so that the moveable carrier can be selectively moved along the tube. The foregoing structure is configured to provide the traverse rod with an aesthetic external appearance, provide a traverse rod that is efficient to assemble and operate, and in a way that maintains the aesthetic appearance of the traverse rod, as well as any surface ornamentation on the components of the traverse rod.

9 Claims, 21 Drawing Sheets

U.S. PATENT DOCUMENTS

| | | | | | |
|---|---|---|---|---|---|
| 3,766,597 | A | * | 10/1973 | Ford et al. | 16/87.4 R |
| 3,881,218 | A | | 5/1975 | Palmer | 16/93 |
| 4,014,071 | A | | 3/1977 | Janson | 16/93 |
| 4,034,439 | A | | 7/1977 | Kohne | 16/96 |
| 4,102,007 | A | | 7/1978 | Janson | 16/94 |
| 4,141,105 | A | * | 2/1979 | Gonon | 16/87.6 R |
| 4,166,306 | A | | 9/1979 | Janson | 16/94 |
| 4,190,927 | A | * | 3/1980 | Hepperle | 16/96 D |
| 4,285,095 | A | | 8/1981 | Janson | 16/94 |
| 4,306,332 | A | | 12/1981 | Simmons | 16/96 |
| 4,402,109 | A | | 9/1983 | Ohman et al. | 16/95 |
| D337,516 | S | | 7/1993 | Williams | D8/377 |
| 5,542,149 | A | | 8/1996 | Yu | 16/87 |
| 5,785,104 | A | | 7/1998 | Riley et al. | 160/38 |
| 6,138,324 | A | * | 10/2000 | Lin | 16/87.6 R |
| 6,189,182 | B1 | | 2/2001 | Ko | 16/87.6 |
| 6,499,708 | B1 | * | 12/2002 | Cowen | 248/261 |

OTHER PUBLICATIONS

2002 Catalog: Distinctive Drapery Hardware Through Innovation. Le Fer Forge. pp. 1-10.
Catalog: Give Your Windows The Special Treatment They Deserve. pp. 1-8.
Catalog: Metal. Kirsch. pp. 1-8.
Catalog: Wood. Kirsch. pp. 1-11.
Catalog: Mixed Media. Kirsch. pp. 1-7.

* cited by examiner

CUSTOM ORNAMENTAL TRAVERSE RODS

RELATED APPLICATION/CLAIM OF PRIORITY

This Application is related to and claims priority from Provisional Application Ser. No. 60/498,908, filed Aug. 29, 2003.

BACKGROUND

The present invention relates to traverse curtain rod structure, that is designed to provide an efficient structure for supporting and manipulating a hanging curtain, drape, wall covering, etc., while also minimizing the risk of damaging the aesthetic features of the curtain rod, as the hanging curtain, drape, wall covering, etc., is being manipulated.

Traverse curtain rods typically are designed to support a hanging object (e.g. a curtain, drape, wall or window covering, etc.), and to enable the hanging object to be manipulated over the span of a wall or ceiling. Such traverse curtain rods may also have various features that are designed to enhance their aesthetic appeal. For example, they may be painted or have other forms of surface decorations. They may also have decorative finials at their ends, that further enhance their aesthetic appeal In order to manipulate a hanging object from a traverse curtain rod, and particularly a relatively heavy object such as a curtain or drape, it is known to provide a traverse cord that is supported by the traverse rod, and connected to the hanging object. The traverse cord is manipulated to draw the hanging object along the span of the traverse rod. In some instances, a traverse cord is not provided or is not used, and the hanging object, which effectively connects the carriers, is grasped and pulled, in order to move the hanging object along the traverse rod.

In the applicants' experience, there is a need to improve the structure of a traverse rod, to maintain or improve the manner in which a hanging object is moved along the span of the traverse rod. Moreover, there is a need to maintain or enhance such functionality, while minimizing the risk of damaging the aesthetic features of the traverse rod as the hanging object is manipulated. For example, if the traverse rod is painted or has some other form of decorative surface ornamentation, applicants believe it is useful to provide for efficient manipulation of the hanging object, while avoiding contact between the object and the rod surface that can wear the surface ornamentation of the rod. Moreover, applicants believe it is desirable to provide a traverse rod that is efficient to assemble and operate.

Specifically, in applicants' experience, certain rods on that market that are decorative with traversing capabilities have only ½ rings. The openings are on the back side of the rod. The rings have a carrier that runs on a track on the backside of the rod and then this glide hangs below the rod, where the drapery pins into. Thus, the carrier can be seen above the drapery top.

Other traverse ornamental type rods of which applicants are aware are made out of thin metal and telescope out. Applicants believe this style is dated and doesn't have the capabilities of the new massive look of the rod and rings, that customers want or need. A center support is needed for this type of rod between every 3 to 4 feet. This is why the rings can only be ½ around. The parts in this type of rod are thin metal and plastic type parts and pieces.

Still other ornamental rods that are presently on the market have metal rings and are hand drawn, with batons. The problem with such rods is that it is very difficult to draw the draperies open and closed. It is almost impossible on a window, when the top of the window is 7 feet from the floor. When you need or want to cover a window where the top of the window maybe anywhere from 7 to 12 feet off the floor, you cannot move the drapes without tearing the fabric after awhile. Getting on a chair can only help if top of window is 8 feet or less from the floor. When you go to open or close the drapes it is very difficult to move rings with the baton, without tearing fabric, struggling with opening and closing of drape. The rings tip and wear off the finish on the rods because it is sliding and bumping the rod. The rings don't move smoothly on the rod they tend to grab the rod and stick and bind. This lends itself to tearing of the fabric. Most of the time people get very annoyed and put the drape in one position and leave them there, then they have a nice look of the rod and rings but they don't have any functioning of the drapery on the rod.

SUMMARY OF THE PRESENT INVENTION

The present invention provides a new and useful traverse rod structure that is designed to improve the functionality of a traverse rod, in respect of the manner in which a hanging object is moved along the span of the traverse rod. Moreover, the traverse rod of the present invention is designed to enhance such functionality, while minimizing the risk of damaging the aesthetic features of the traverse rod as the hanging object is manipulated. Still further, the present invention provides a traverse rod that has an attractive and aesthetic external appearance, while enhancing the functionality of the traverse rod. In addition, the present invention provides a traverse rod that is efficient to assemble and operate.

In its preferred form, a traverse rod according to the present invention comprises (a) a longitudinally extending tube having an opening extending along the tube, (b) a longitudinally extending track located within the tube, the track comprising a pair of substantially co-planar track sections with a gap therebetween, and (c) one or more moveable carriers each of which is configured to engage a wall covering. Each moveable carrier has a follower extending through the opening in the tube. The follower has a first portion located at least partially in the gap in the pair of track sections and engaging the pair of substantially co-planar track sections such that the follower can ride along the track, so that the moveable carrier can be selectively moved along the tube. The foregoing structure is configured to provide the traverse rod with an aesthetic external appearance, provide a traverse rod that is efficient to assemble and operate, and in a way that maintains the aesthetic appearance of the traverse rod, as well as any surface ornamentation on the components of the traverse rod.

With a traverse rod according to a preferred embodiment, which uses stronger, thicker metal, non-telescoping rod, you can install a rod with no or only one center support, depending on the length of the rod. This center support will not hinder the movements of the full ring up to and away from the center support. This tubular metal traverse rod has full circle metal rings that provide the aesthetics, and will function properly with ease of opening and closing of drapes or other hanging objects. The tubular metal rod provides the look of the baton (no traverse), but with smooth and ease of a traverse system with the metal bearing wheels and full circle metal rings. The finish or other aesthetics of the rod stays like new, because the tubular metal rod and full circle rings don't wear off the finish. They are all custom colored, choice of size of the rod, and style of rod round or square, all of which provide the rod with aesthetic appearance, while enhancing the functionality of the rod.

Further features of the present invention will become apparent from the following detailed description and the accompanying drawings and Exhibits.

BRIEF DESCRIPTION OF THE DRAWINGS AND EXHIBITS

Figure 10A:
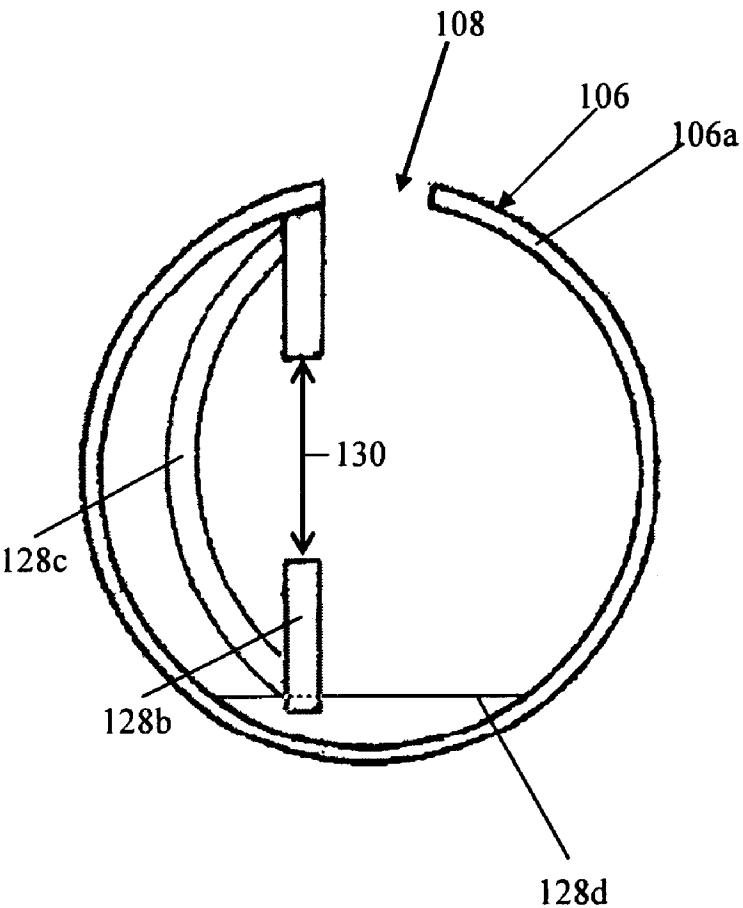
FIG. 10 is an end view of the track and tube of FIGS. 6–9.
Figure 10:
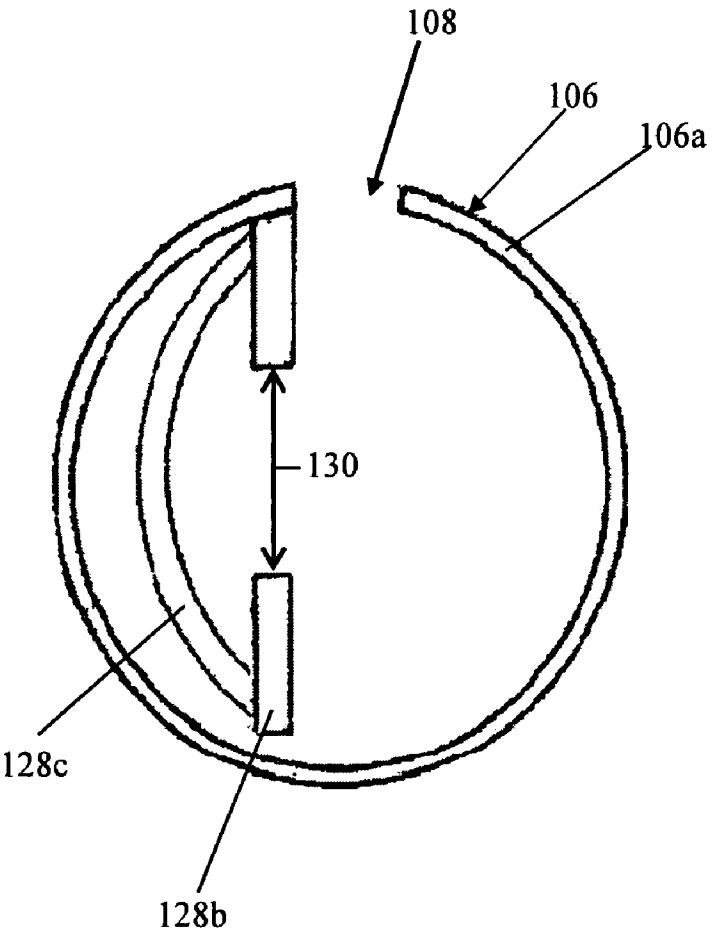
Figures 11, 12:
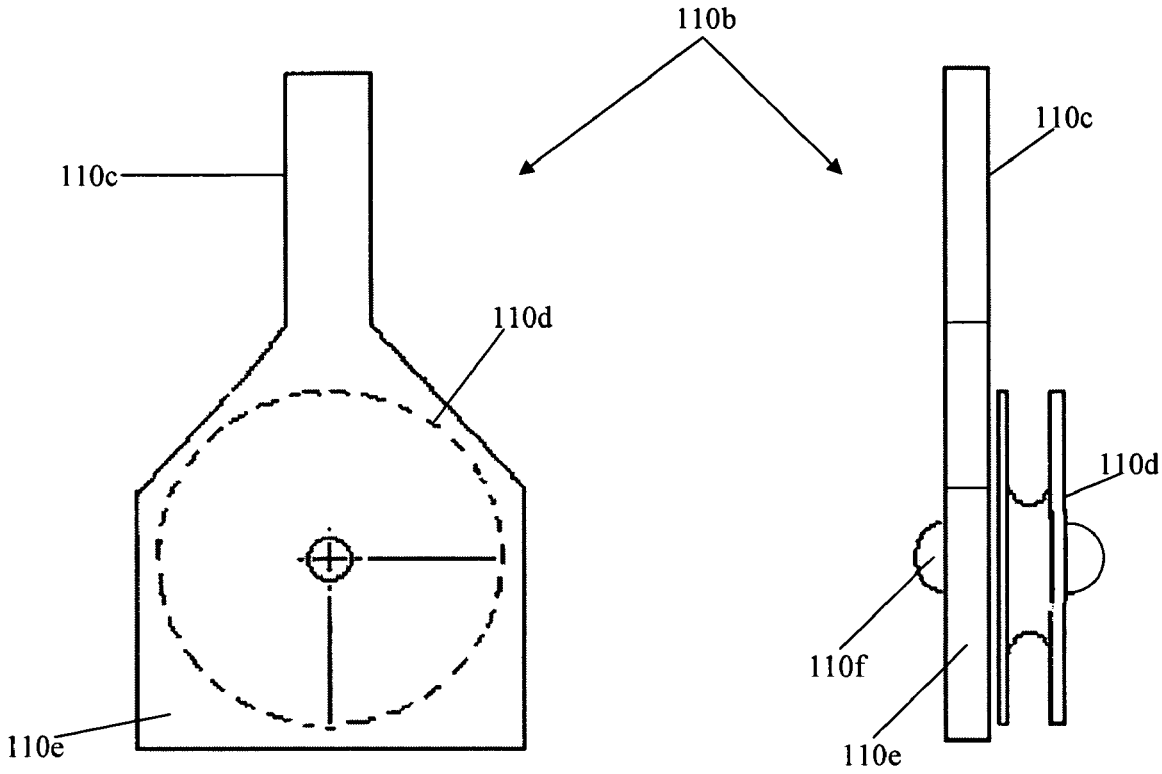
Figure 13:
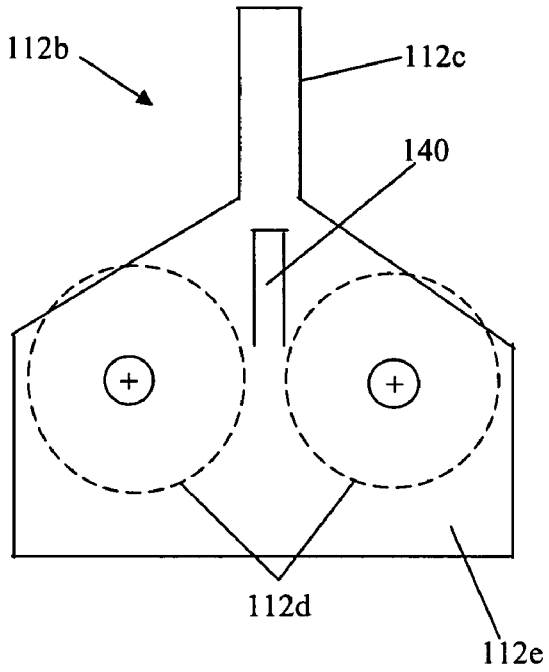
Figure 14:
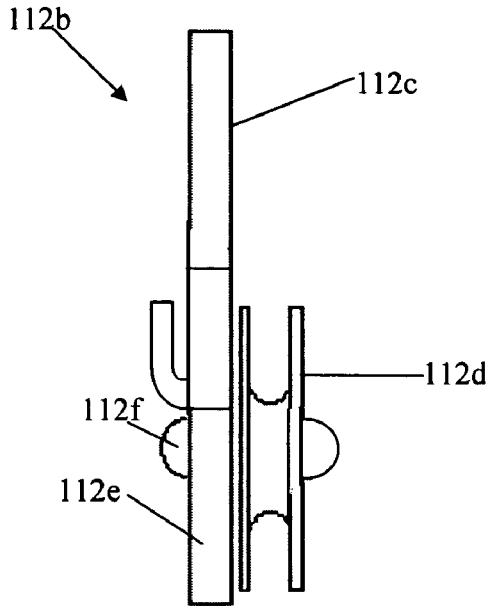
Figure 16:
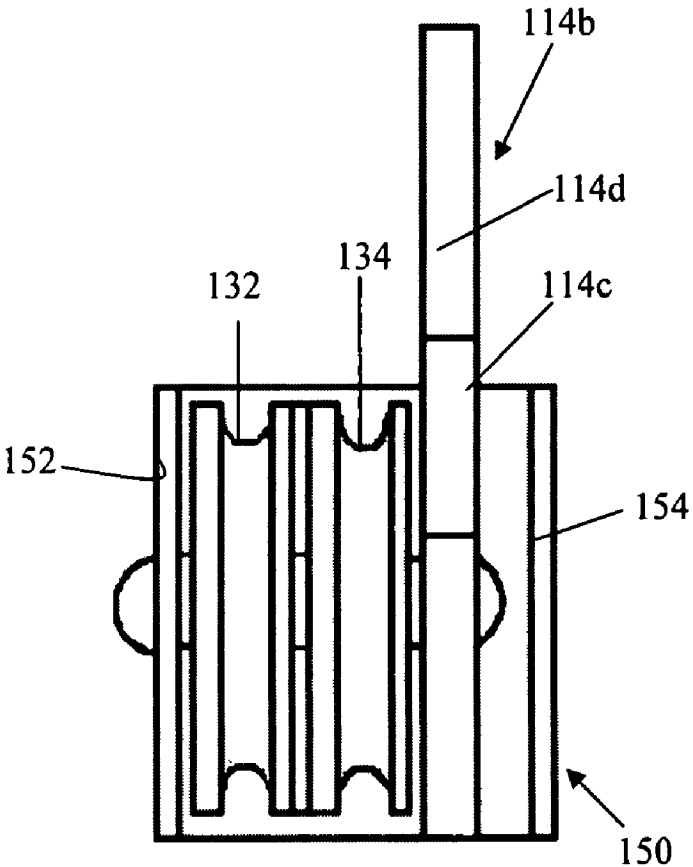
Figure 15:
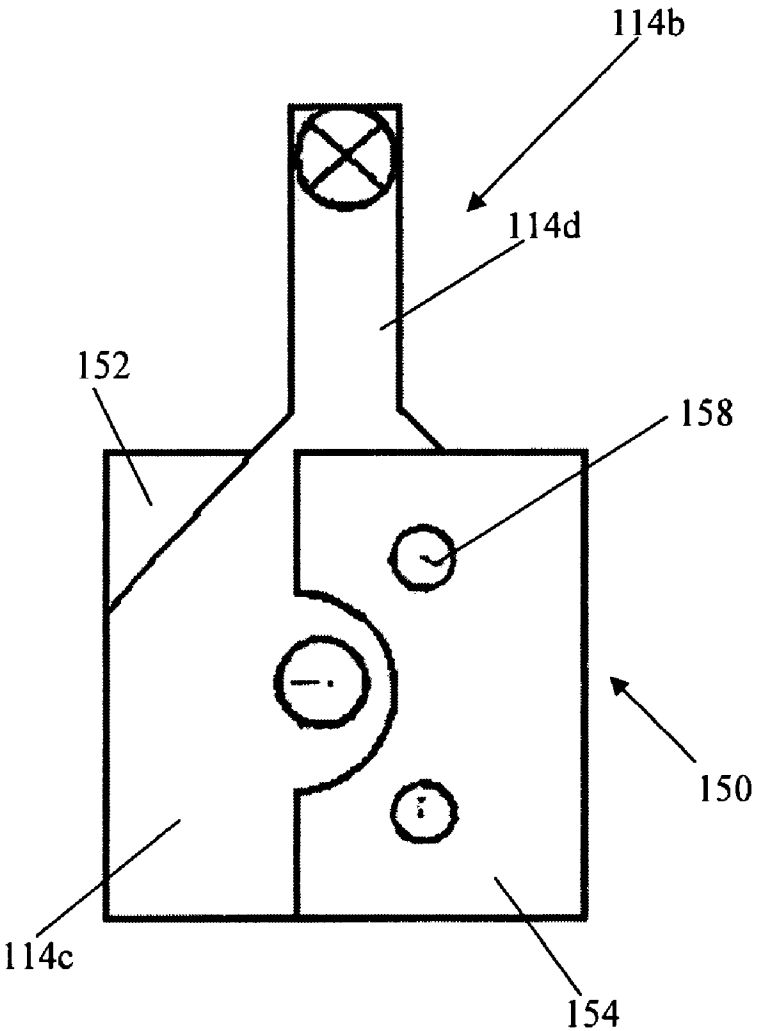
Figure 17:
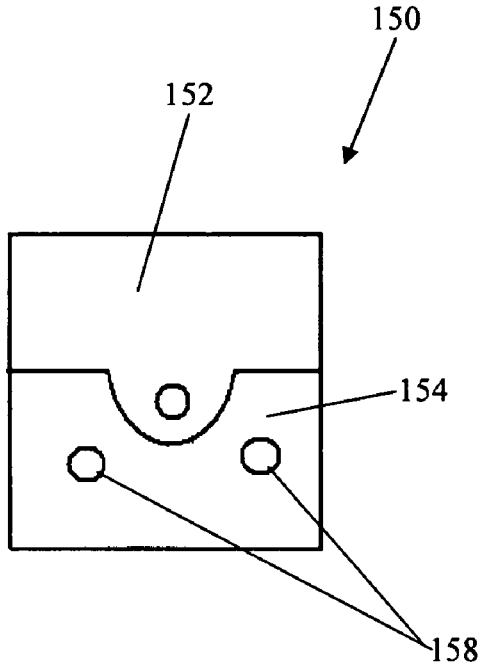
Figure 18:
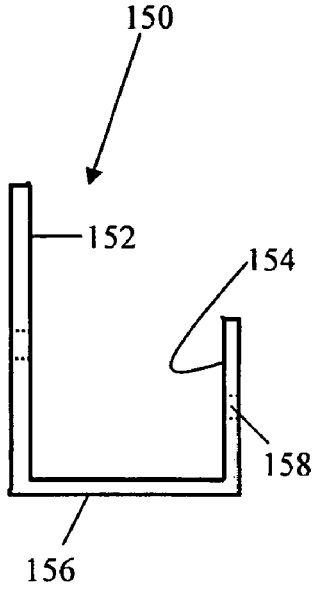
Figure 20:
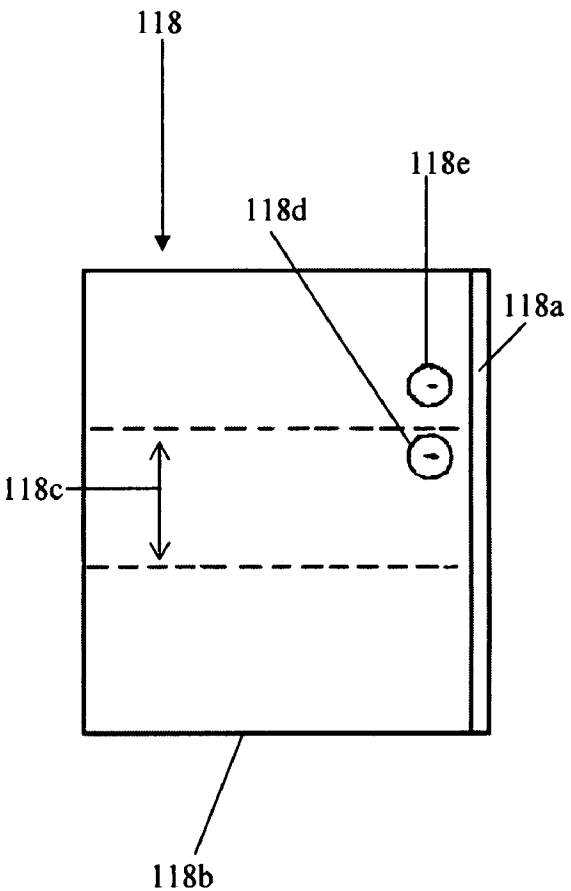
Figure 21:
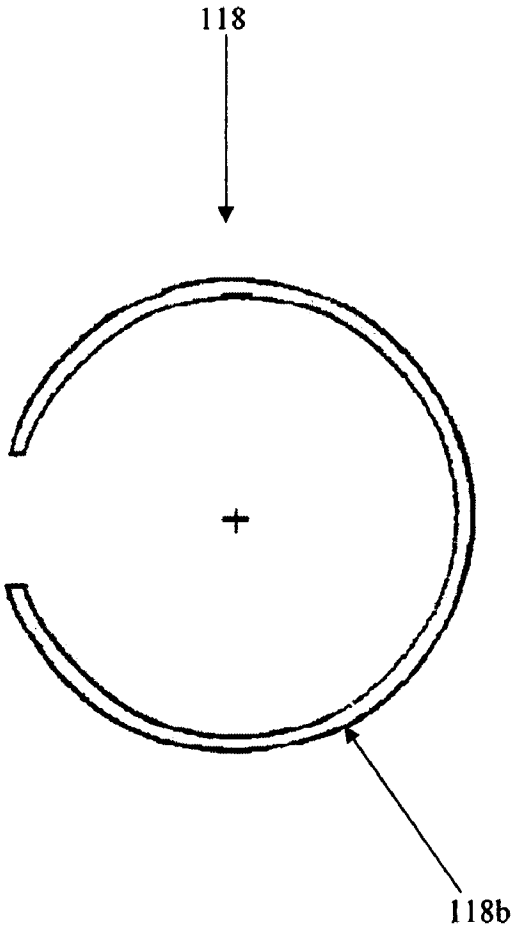
Figure 19:
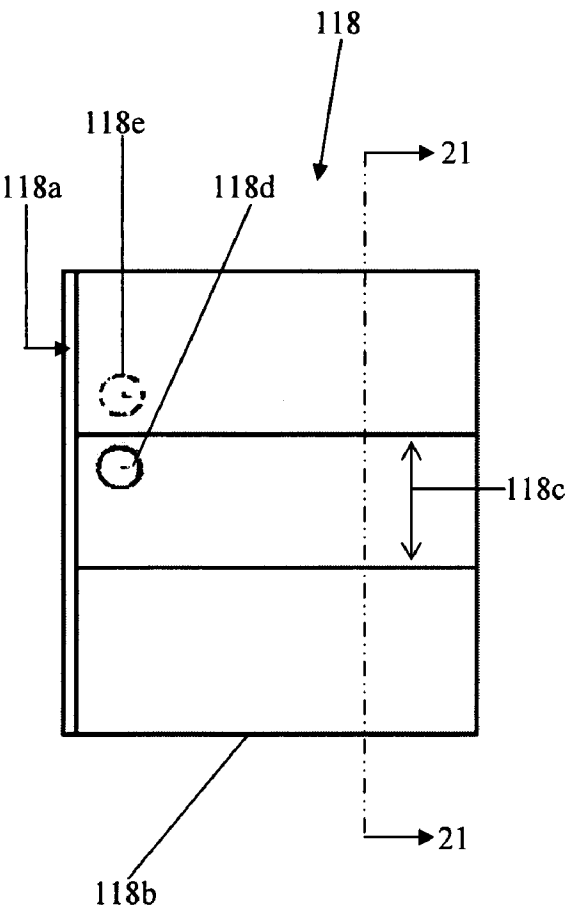
Figure 22:
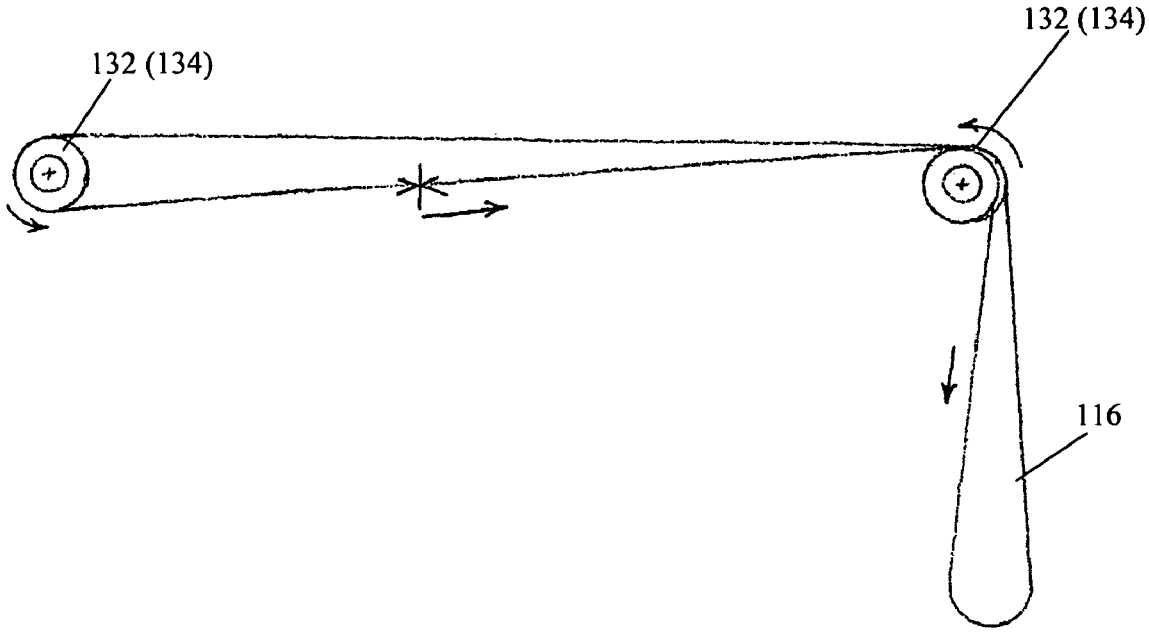
Figure 23:
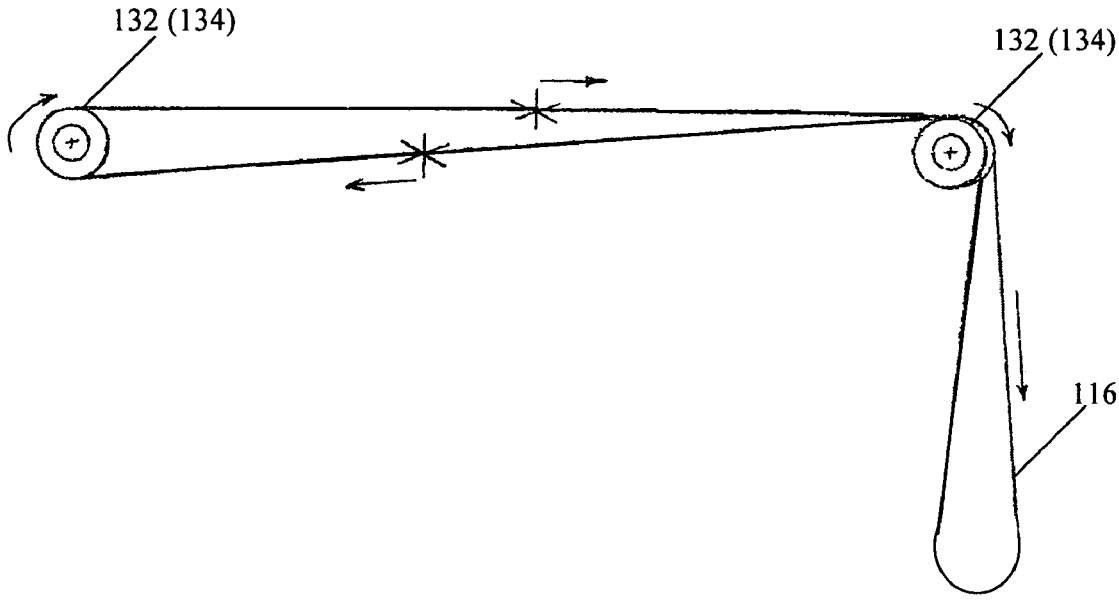
Figures 24, 25:
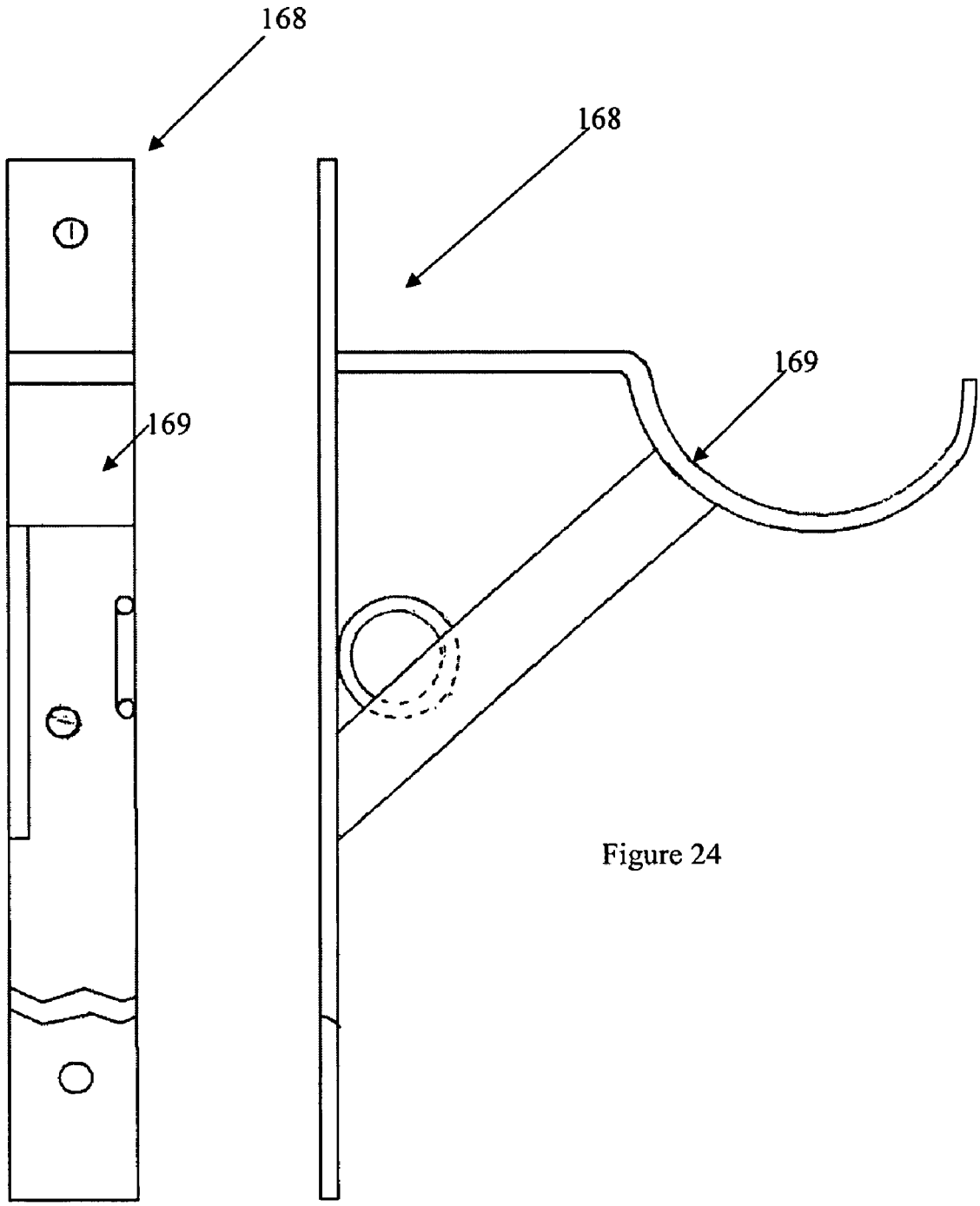
Figure 26:
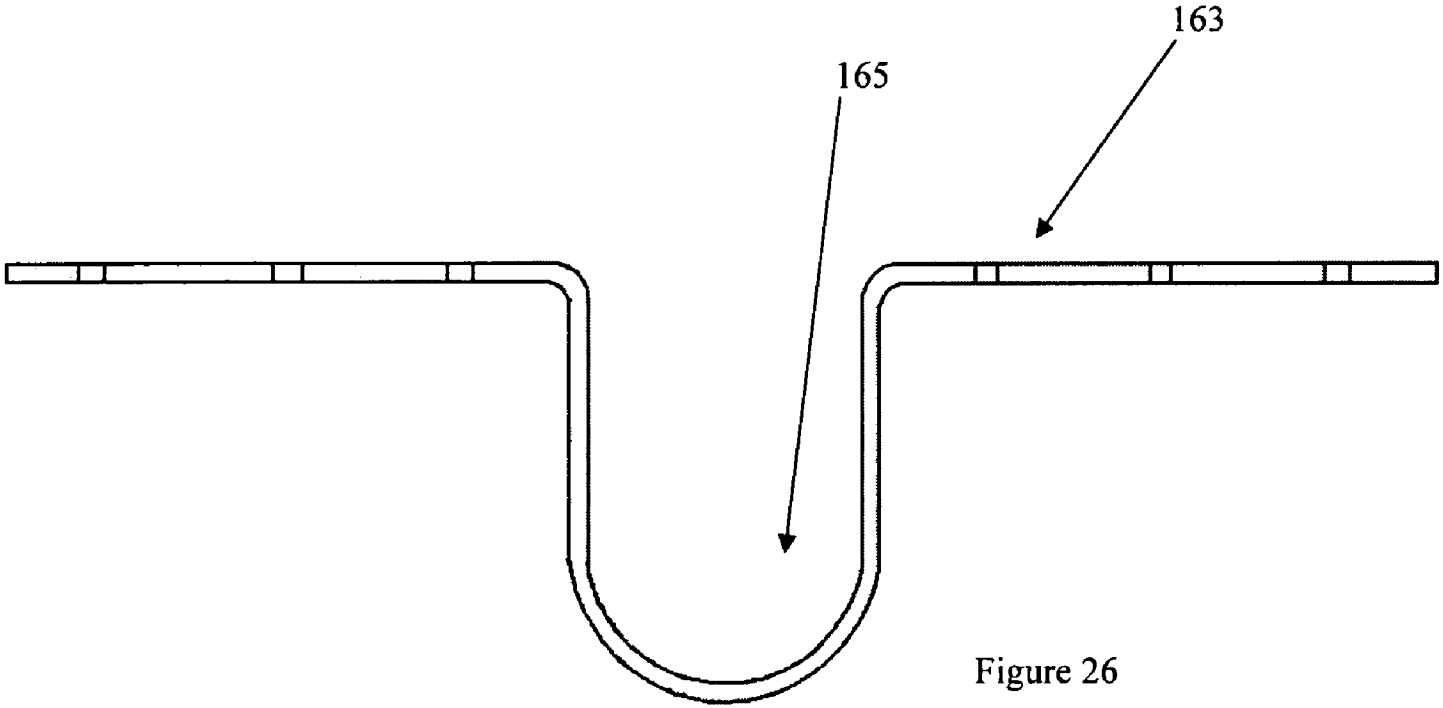
Figure 27:
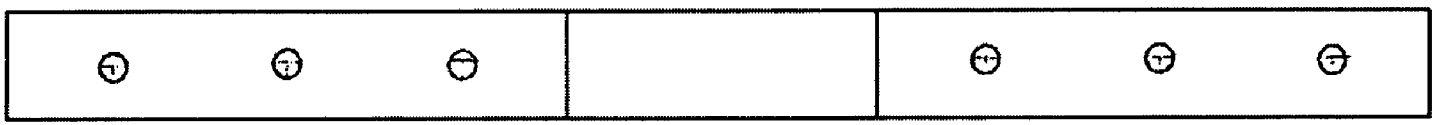
Figure 28:
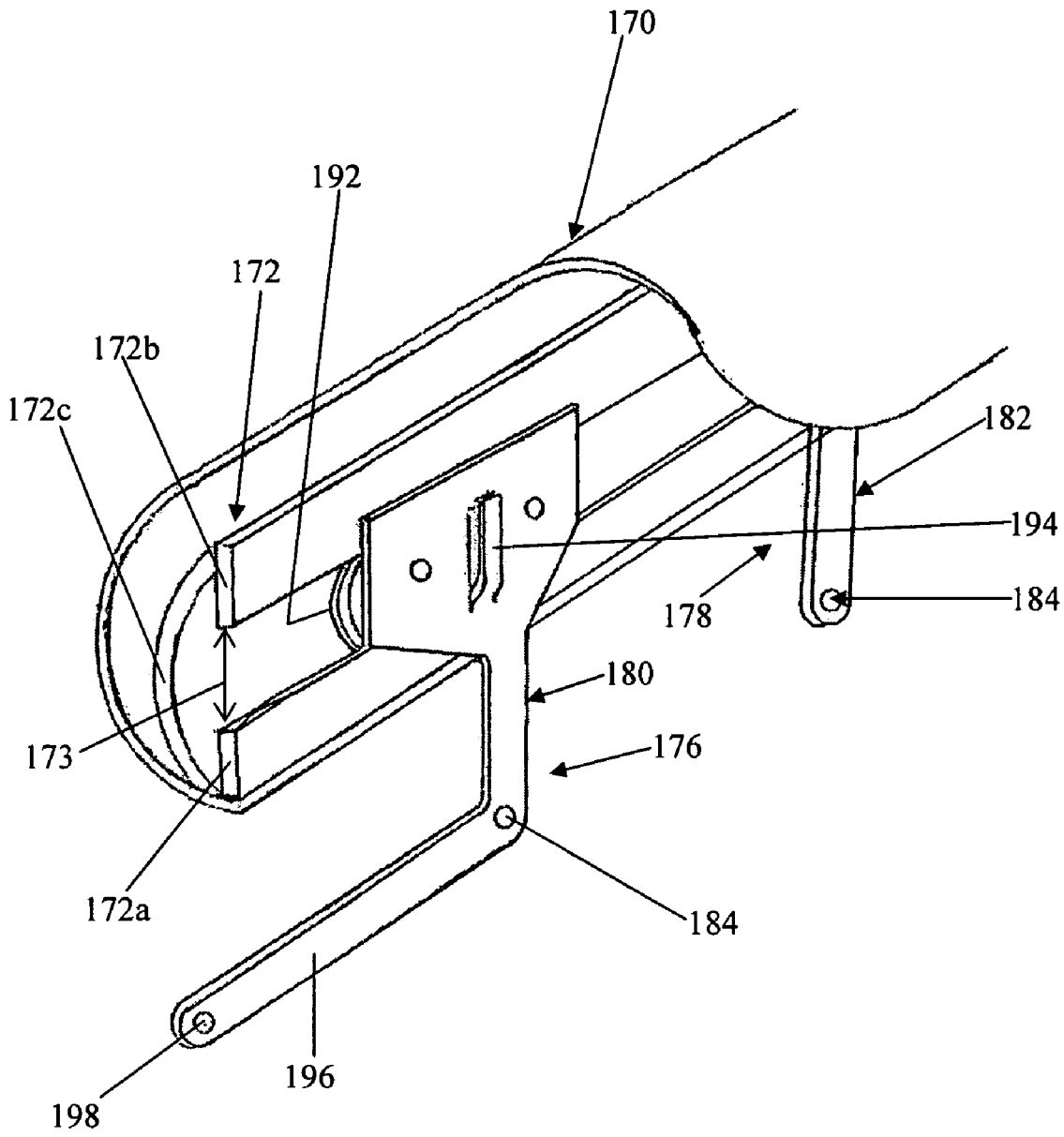
Figure 29:
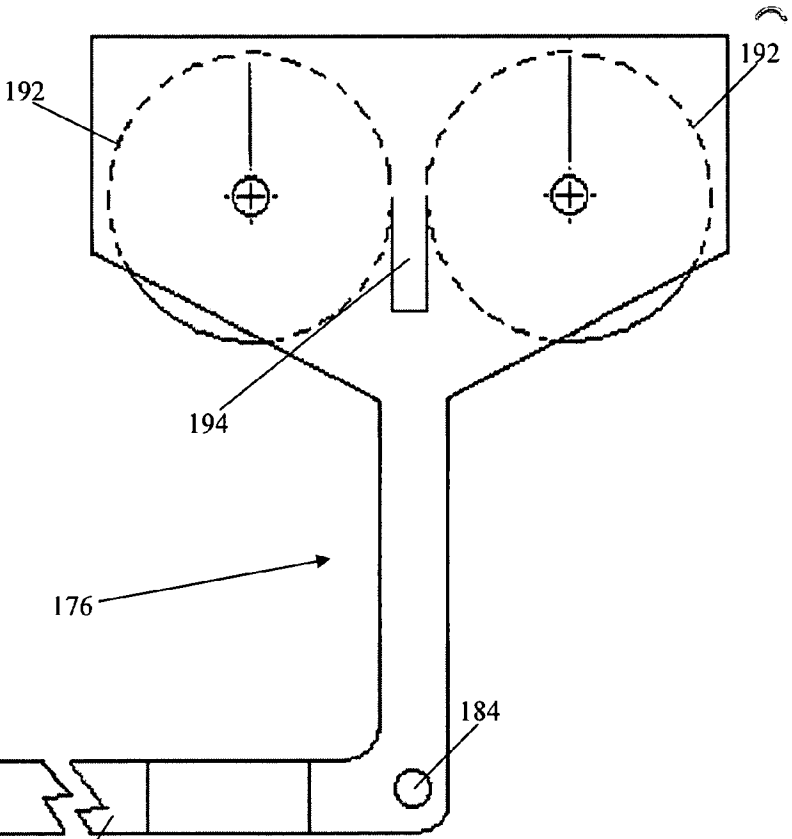

FIG. 10*a* is an end view of a modified track and tube;

FIG. 11 is a schematic side view of a follower for a moveable carrier, according to the present invention;

FIG. 12 is a right end view of the follower of FIG. 11;

FIG. 13 is a schematic side view of a follower for a lead carrier, according to the principles of the present invention;

FIG. 14 is a right end view of the follower of FIG. 13;

FIG. 15 is a schematic side view of a carrier and guide wheel subassembly for a stationary carrier, according to the present invention;

FIG. 16 is a left end view of the carrier of FIG. 15;

FIG. 17 is a side view of a coupling bracket for a stationary carrier and guide wheel subassembly, according to the principles of the present invention;

FIG. 18 is a right end view of the coupling bracket of FIG. 17;

FIGS. 19–21 are schematic top, bottom and sectional views, respectively, of an end cap for a traverse rod according to the present invention (FIG. 21 being a section of FIG. 19, taken from the direction 21—21);

FIGS. 22, 23 are schematic views of a traverse cords configured for one and two way draws, for use with a traverse rod according to the present invention;

FIG. 24 is a schematic side view of a wall bracket for supporting a traverse rod formed according to the present invention;

FIG. 25 is a right end view of the wall bracket of FIG. 24;

FIG. 26 is a schematic side view of a ceiling bracket for supporting a traverse rod formed according to the present invention;

FIG. 27 is a top view of the ceiling bracket of FIG. 26;

FIG. 28 is a schematic, fragmentary, three dimensional view, with portions broken away, of components of a traverse rod according to a modified form of the present invention;

FIG. 29 is a schematic side view of a lead carrier for a traverse rod of the type shown in FIG. 28

Figure 30A:
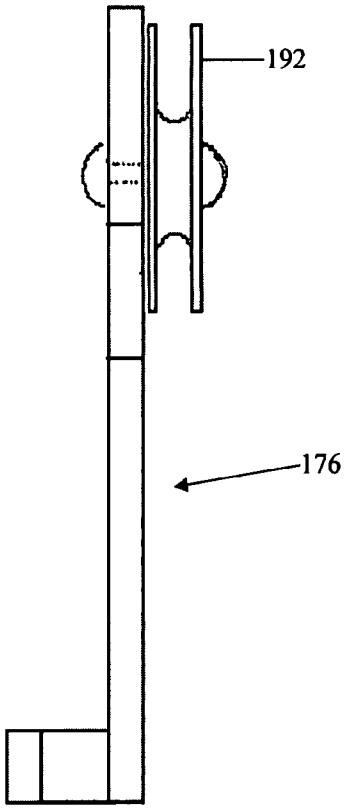
Figure 30B:
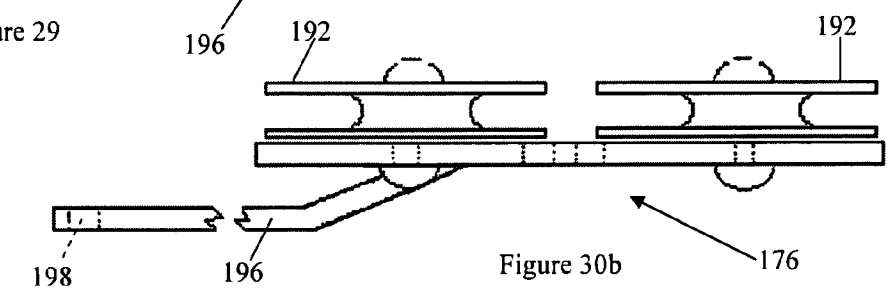
Figure 31:
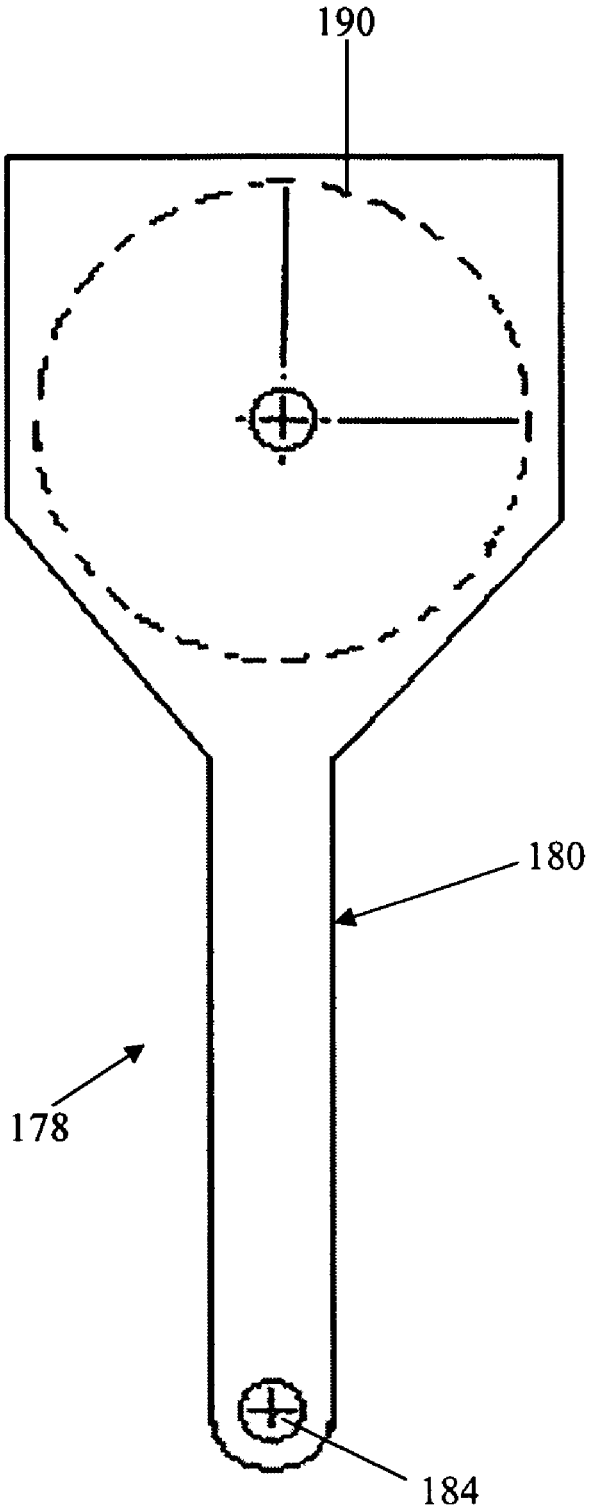
Figure 32:
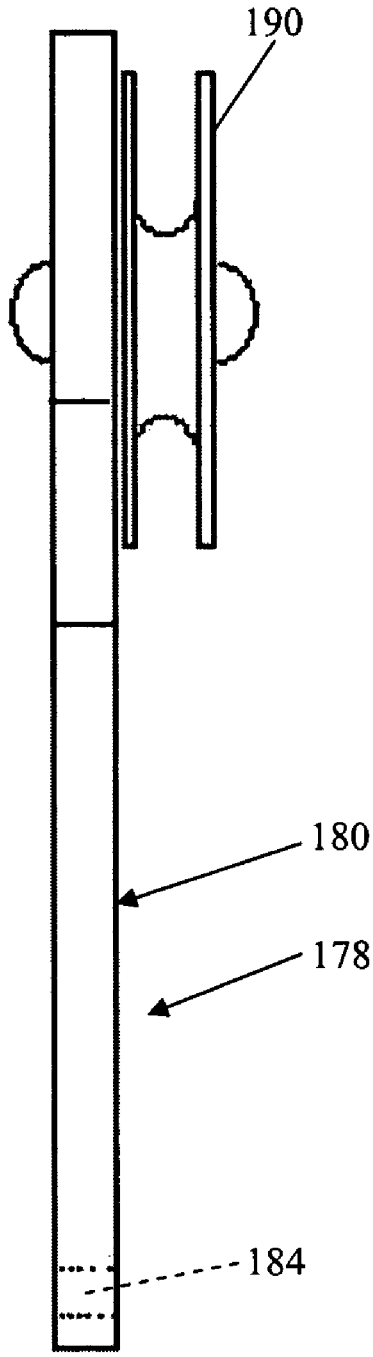

FIG. 30*a* is a right end view of the lead carrier of FIG. 29;

FIG. 30*b* is a top view of the lead carrier of FIG. 29;

FIG. 31 is a schematic side view of a carrier post other than a lead carrier post, for a traverse rod of the type shown in FIG. 28;

FIG. 32 is a left end view of the carrier post of FIG. 31; and

Figure 33:
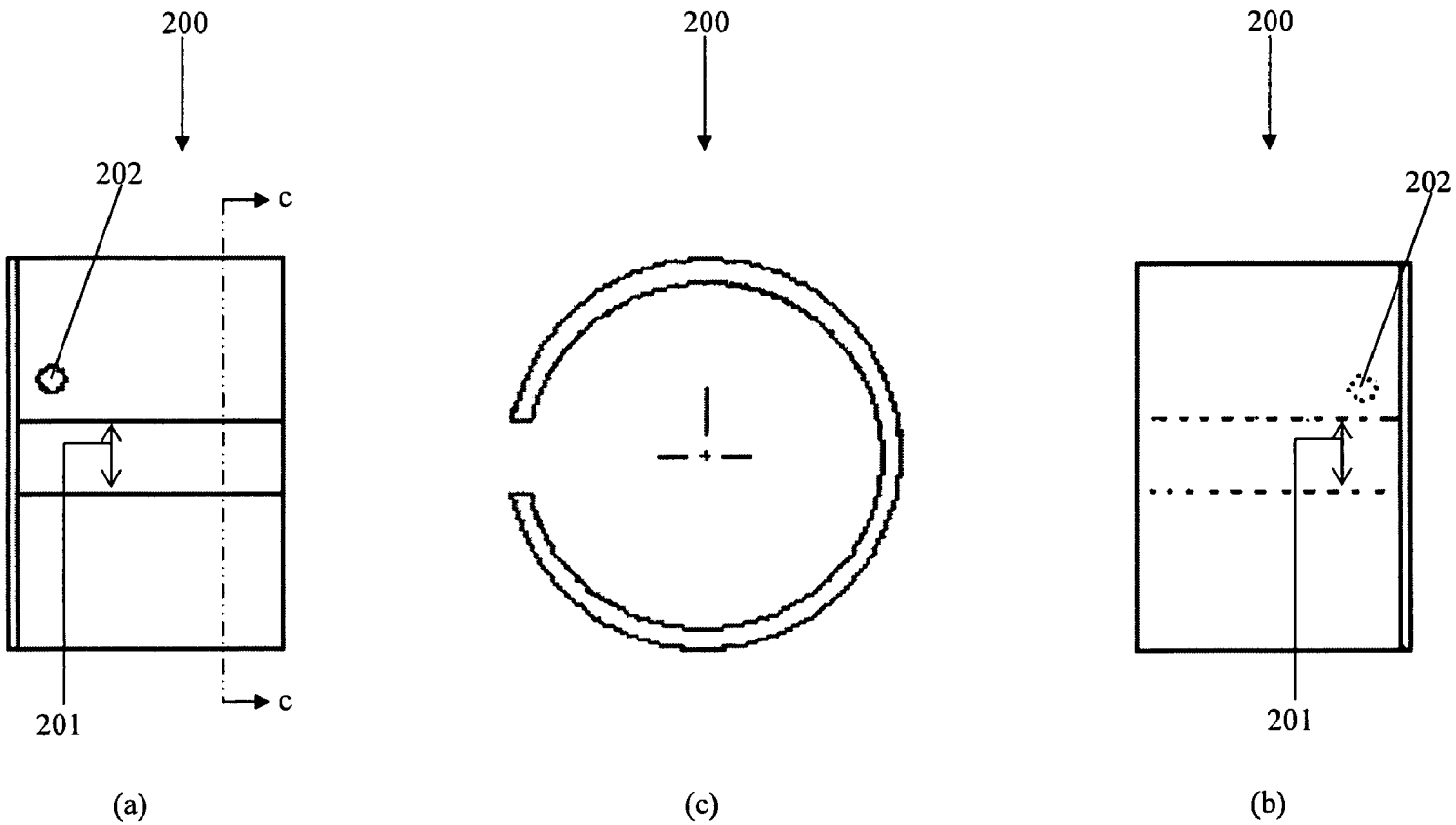

FIGS. 33*a*–*c* are schematic bottom, top and sectional views, respectively, of an end cap for the modified version of the invention (FIG. 33*c* being a sectional view taken from c—c of FIG. 33*a*).

Exhibits A–D are copies of photos of traverse rods and/or components according to the foregoing embodiments.

DETAILED DESCRIPTION

As described above, the present invention provides a traverse rod that is designed to be efficient to assemble and operate, to provide an aesthetic external appearance, and to provide a structure that enables efficient manipulation of a hanging object, while minimizing the risk of damaging aesthetic surface ornamentation on the traverse rod structure. The principles of the present invention are described below, primarily in connection with two embodiments of traverse rod, and it will be clear to those in the art from that description how the principles of the present invention can be used to form various versions of such a traverse rod.

Figure 1:
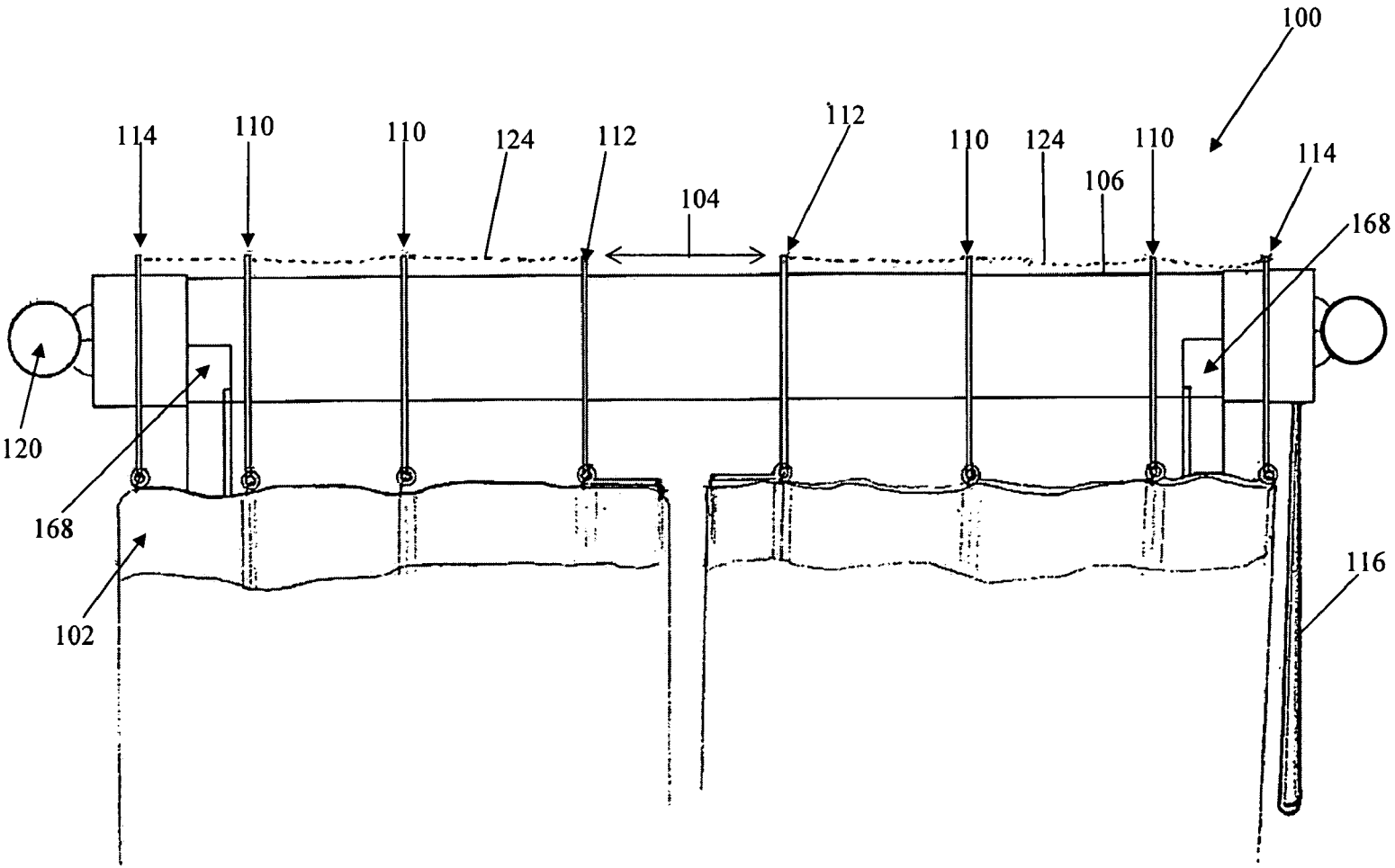
FIG. 1 is a schematic illustration of a portion of a traverse rod according to the present invention, with the top portion of a curtain or drape suspended therefrom.

As shown in FIG. 1, a traverse rod 100, according to the present invention, is designed to support a hanging object 102, and to enable the hanging object to be moved in opposite directions (e.g. in the directions of arrows 104) along the span of the traverse rod 100. In FIG. 1, the hanging object 102 is a curtain or drape, but it is contemplated that a traverse rod 100 according to the present invention can be configured to support various additional types of hanging objects, e.g. window coverings, blinds, drapes and curtains of the type that may be found in theatre sets, etc. Moreover, a traverse rod according to the present invention can be supported from a wall, ceiling, or other convenient location to which a support bracket can be attached.

As further shown in FIGS. 1–5, the basic external components of the traverse rod 102 are a longitudinal tube 106 having a longitudinally extending slot or opening 108 in its upper side, and a plurality of moveable carriers 110, 112 and a stationary carrier 114 located along the span of the tube 106. The carrier 112 is referred to as a lead carrier; because it is connected with a traverse cord 116 (described below) in a manner that enables the lead carrier to be actuated by the traverse cord effectively to lead the movement of the hanging object 102 in the opposite directions 104. The stationary carrier 114 is located at a fixed position along the tube 106, and is configured to engage and guide the traverse cord 116 and enable the traverse cord to conveniently maneuver the moveable carriers 110, 112 and the hanging object 102.

The moveable carriers 110 other than the lead carrier 112 are preferably configured as shown by FIGS. 2, 4, 11 and 12. There may be more than one such moveable carrier 110 located between the lead carrier 112 and the stationary carrier 114, but for convenience, only one moveable carrier 110 is shown. An internal track, that is shown and described below, is provided inside the tube 106, and co-operates with follower structure, also described below, to enable efficient movement of the moveable carriers along the span of the tube 106.

Figure 2:
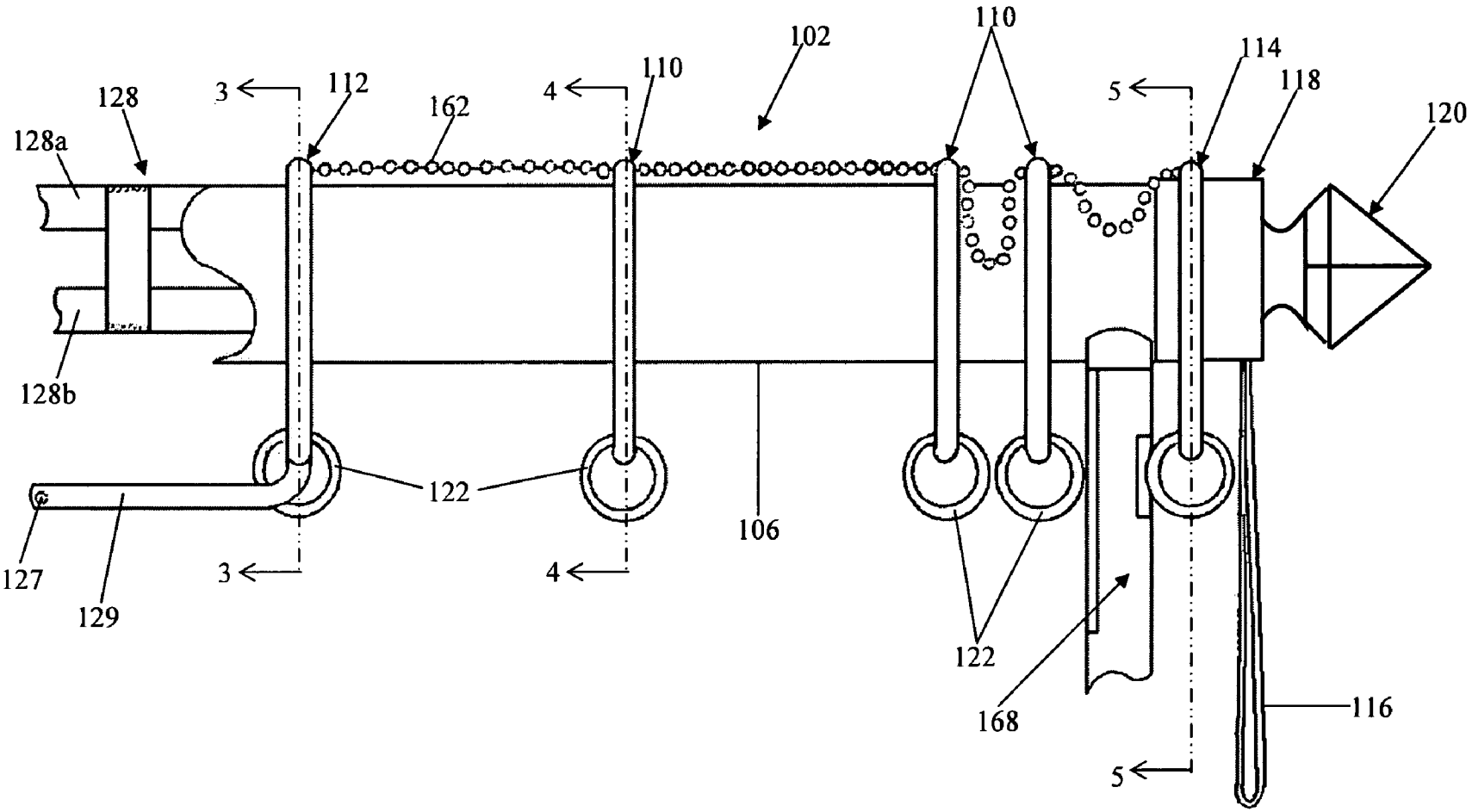
FIG. 2 is a schematic illustration of a portion of a traverse rod according to the present invention, with portions cut away.
Figure 3:
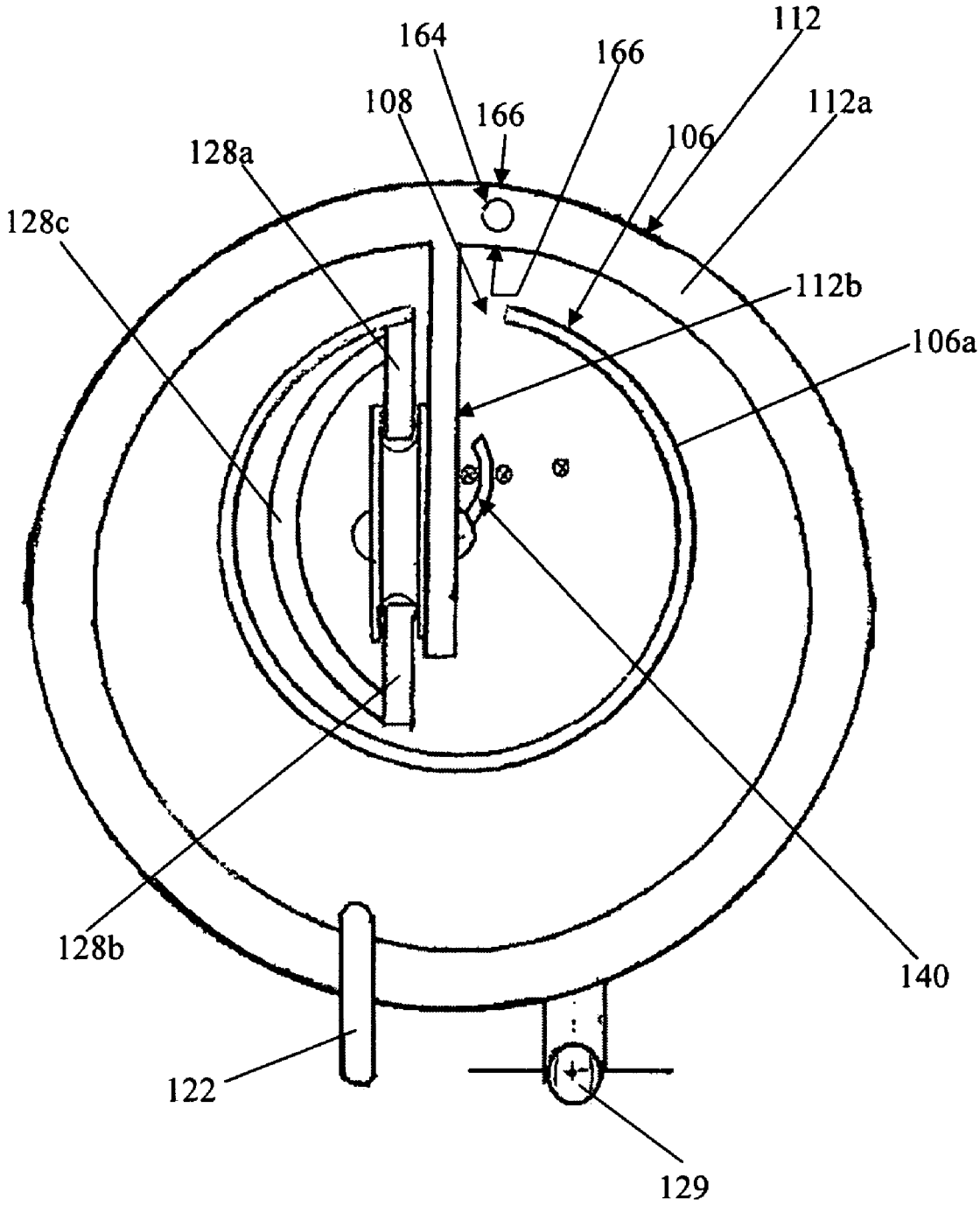
FIGS. 3–5 are cross sectional views of the traverse rod of FIG. 2, taken from the directions 3—3, 4—4 and 5—5, respectively.
Figure 4:
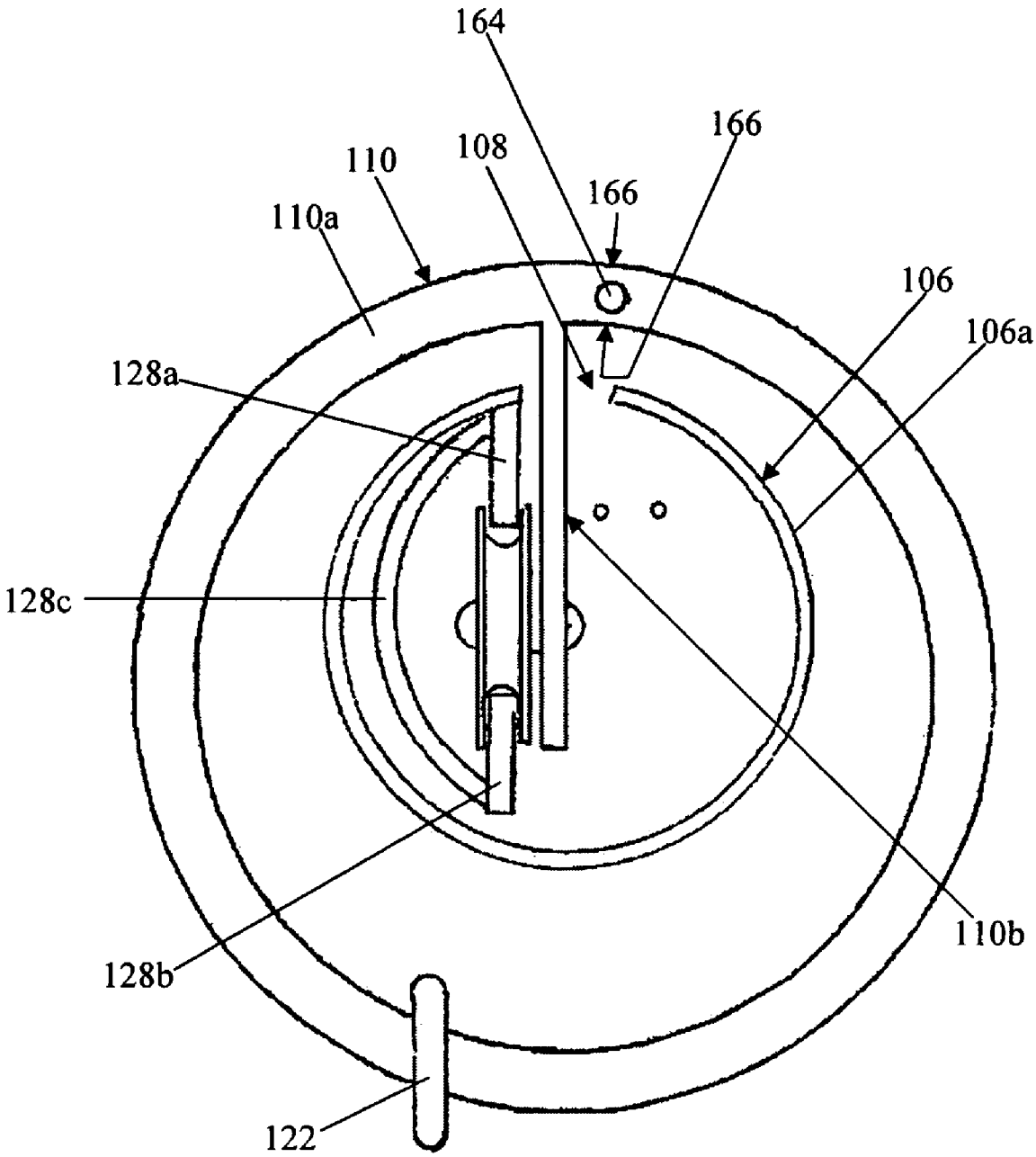
Figure 5:
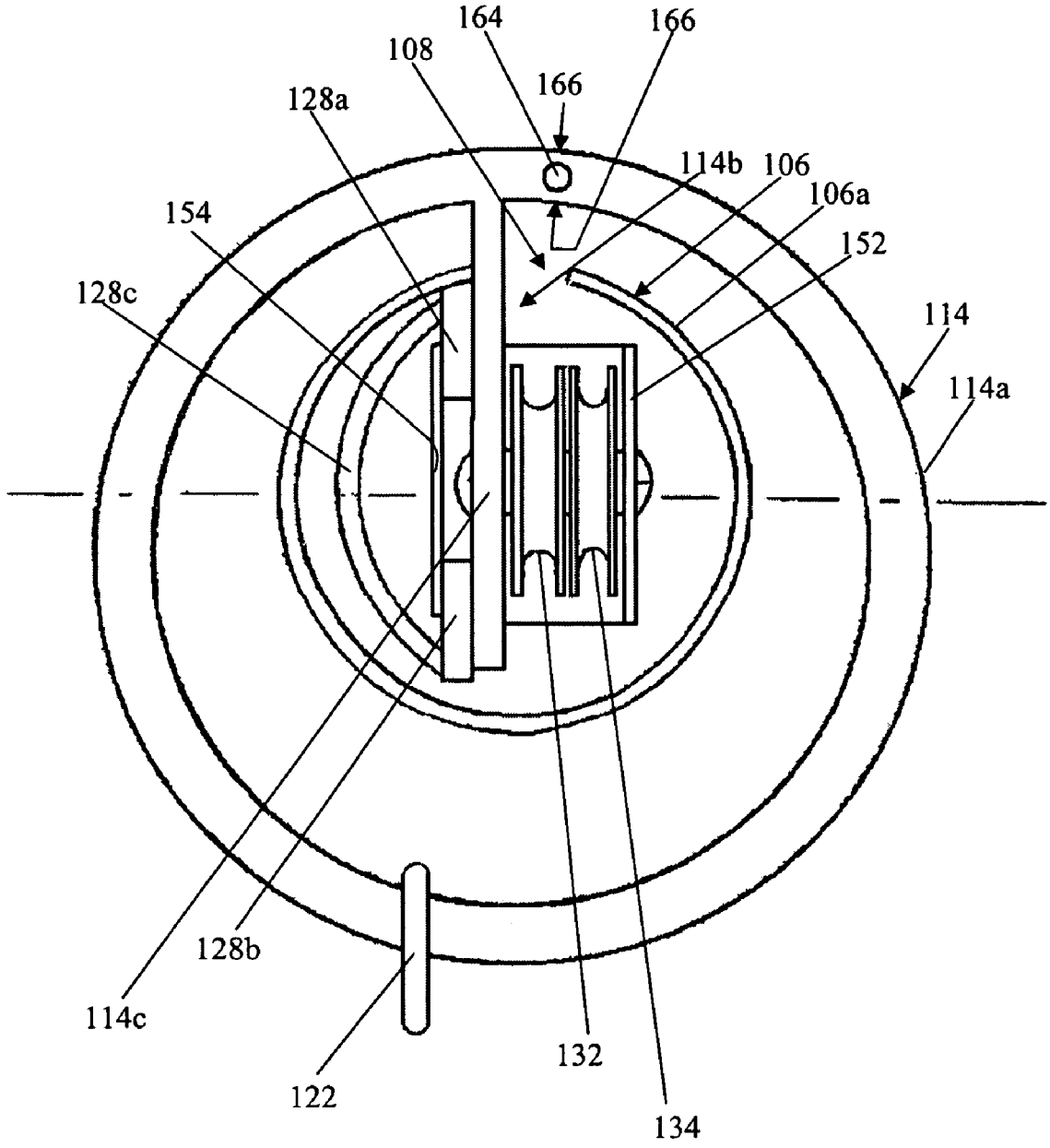
Figure 6:
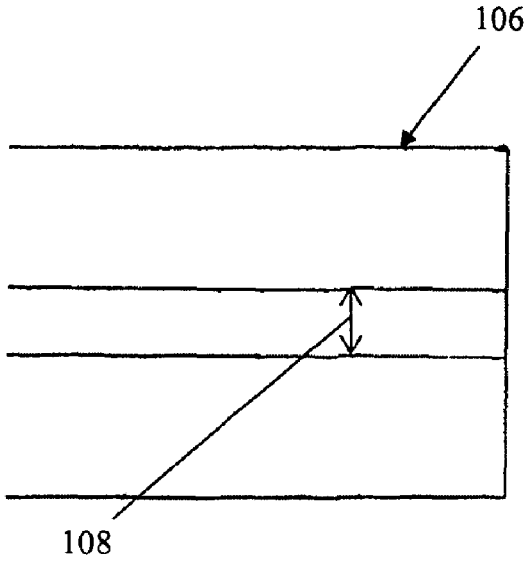
FIG. 6 is a schematic, fragmentary top view of a tube forming part of a traverse rod according to the present invention.
Figure 7:
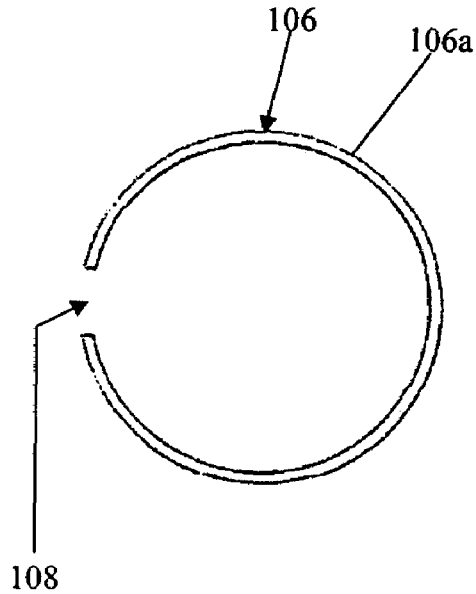
FIG. 7 is an end view of the tube of FIG. 6.
Figures 8, 9:
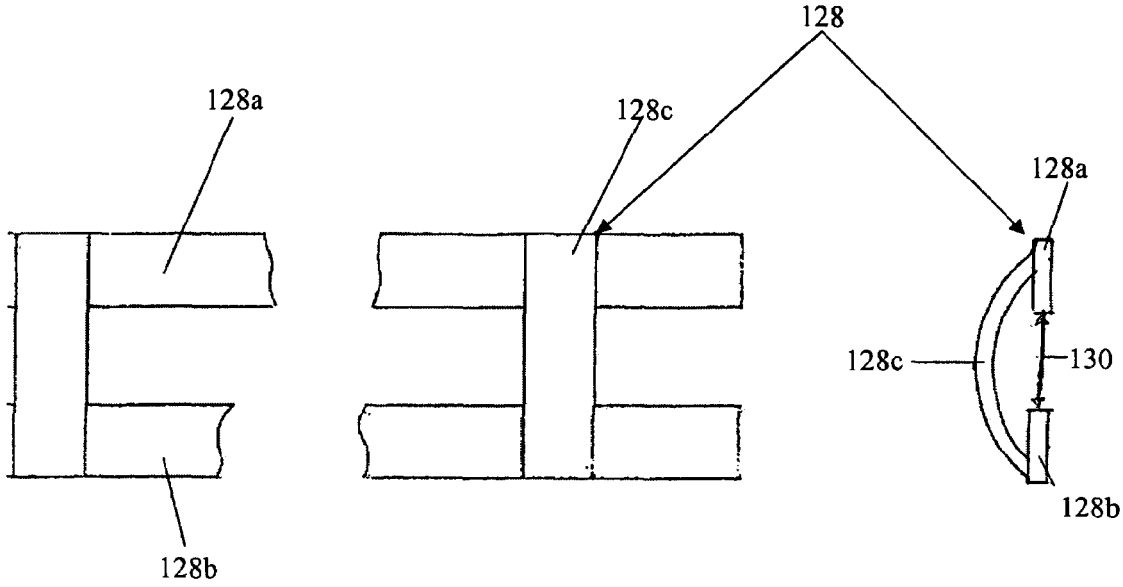
FIG. 8 is a schematic, fragmentary side view of a track that is inside the tube of FIGS. 6 and 7, according to the principles of the present invention.
FIG. 9 is an end view of the track of FIG. 8.

In addition to the basic traverse rod components described above, the traverse rod may include a traverse cord 116, for use in maneuvering the moveable carriers and the hanging objects along the span of the tube 106. In addition, an end cap 118 may be provided (at each end of the tube 106 if a single tube supports the wall covering) and decorative end finials 120, of different styles and shapes, can be attached to the end cap(s), to improve the aesthetics of the traverse rod. Still further, connecting rings 122 can be provided on each carrier, which can slide freely on the carrier, to enable a hanging object 102 to be attached to the carriers. Also, a connecting chain 124 can extend between adjacent carriers, to provide a measure of control of the spacing between the carriers as the hanging object is moved along the span of the tube 106. Still further, while one stationary carrier 114 and one lead carrier 112 are illustrated in FIG. 2, it will be appreciated by those in the art that in many instances there will be a stationary carrier and a set of moveable carriers at opposite ends of a tube 106, with each set of moveable carriers including a lead carrier, so that the hanging object can be conveniently be drawn in opposite directions to open and close a space such as a window, a theatre area, etc.

The internal track, a nd the configurations of the moveable carriers that enable them to move along the tube, can be appreciated from FIGS. 3–4 and 11–14. As seen from FIGS. 3, 4, the moveable carriers 110 and 112 each comprises a ring 110*a*, 112*a*, respectively, that has a larger diameter than the tube 106, such that there is significant clearance between the rings 1110*a*, 112*a* and the outer surface 106*a* of the tube, as the moveable carrier moves along the span of the tube. The rings 110*a*, 112*a* are sometimes referred to as "full circle rings".

Thus, as the moveable carriers 110, 112 move along the span of the tube, they should not engage and cause any wear on any surface ornamentation on the outer surface 106*a* of the tube. Moreover, the clearance between the lower portions of the rings 110*a*, 112*a* and the lower portion of the tube is sufficient (e.g. at least ¾ inch) that a hanging object connected to the connecting rings should have sufficient clearance from the tube such that the hanging object should not rub against the outer surface of the tube and cause wear on any surface ornamentation on the tube.

The tube 106 has an internal track 128, and each moveable carrier has a follower (sometimes referred to as a "carrier post" and described further below) that extends into the tube and rides along the internal track of the tube. The internal track comprises a pair of track sections 128*a*, 128*b* that are coplanar with each other, a nd one or more connecting pieces 128*c* that extend between the track sections 128*a*, 128*b*. The track sections 128*a*, 128*b* have a gap 130 between them, and the connecting piece(s) 128*c* are connected to the track sections 128*a*, 128*b* in a manner that maintains the gap 130 at a predetermined distance. Preferably, the tube 106, the track sections 128*a*, 128*b* and the connecting piece(s) 128*c* are all made of steel. The upper track section 128*a* is spot welded to the inside of the tube, just adjacent to the opening 108. The connecting piece(s) 128*c* are spot welded to the upper and lower track sections 128*a*, 128*b*. *Thus, the internal track* 128 can be formed by welding the connecting piece(s) 128*c* to the track sections 128*a*, 128*b*. The internal track 128 can be connected to the inside of the tube 106 by welding the upper track section 128 to the inside of the tube 106 adjacent to the opening 108 of the tube.

FIG. 10*a* shows a modified form of track, according to the principles of the present invention. The track 128 includes support clips 128*d* at spaced locations along the length of the track. Specifically, the support clips 128*d* would be located at 24 inch intervals along the track. The support clips 128*d* are preferably welded to the lower track section 128*b*, and have bottom portions shaped to fit closely inside the tube. The support clips serve to stabilize and strengthen the track.

Each moveable ring 110*a*, 112*a*, has a follower 110*b*, 112*b*. The follower has a carrier post 10*c*, 112*c* that extends downward from the top of the ring and downward through the opening 108 in the upper side of the tube and into the central portion of the tube. Moreover, each follower has a roller bearing portion 10*d*, 112*d* that is coupled to a respective central plate 110*e*, 112*e* that is formed in one piece with the carrier post. Each roller bearing portion 110*d*, 112*d* has a wheel that is located in the gap 130 in the track sections 128*a*, 128*b*, and engages and rolls along each of the track sections 128*a*, 128*b*. Additionally, it is preferred that each roller bearing 110*d* for a carrier 110 comprises a single roller bearing connected to a central plate 110*e* of the carrier post for the carrier 110, and the roller bearing for the lead carrier 112 comprises a pair of roller bearings 112*d*, each connected to a central plate 112*e* of the carrier post for the lead carrier 112. The pair of roller bearings 112*d* on the lead carrier are designed to minimize the likelihood of the lead carrier tilting when it is attached to a relative heavy hanging object and its movement along the tube is initiated. As can be seen from FIGS. 11–14, each carrier post essentially comprises a tapered portion that is formed in one piece with a respective central plate, and tapers from the central plate, so that the tapered portion can easily fit through the opening 108 in the tube 106. The followers and roller bearings are all preferably made of steel; the followers are preferably welded to the rings 110, 112, and the roller bearings are fastened to the followers by rivets or other types of fasteners that allow the roller bearings to roll freely.

Thus, from the foregoing description it should be clear to those in the art that the moveable carriers 110, 112 have roller bearings, preferably the lead carrier has a pair of roller bearings, that roll along the internal track 128 in the tube, to enable the moveable carriers to move along the span of the tube Moreover, it should be clear that the hanging object can be connected to the moveable carriers, so that movement of the moveable carriers along the span of the tube will move the hanging object along the span of the tube. Also, as set forth above, the lead carrier 112 has a pair of roller bearings, located centrally on the central plate of its follower, and each of the pair of roller bearings engages the track sections 128*a* and 128*b*. In addition, the lead carrier 112 has a forward extending arm 129 coupled to the ring 112*a* of the lead carrier. The arm 129 has a forward opening 127 so that the forward end of a hanging object can be coupled to both the arm 129 and also to the coupling ring 122 that is on the ring 112*a* of the lead carrier. Thus, if a relatively heavy hanging object is connected to the moveable carriers 110, 112, and movement of the lead carrier 112 is initiated, the pair of wheels that are on the lead carrier and engage the track sections 128*a* and 128*b* minimizes the likelihood of the lead carrier tilting to any appreciable degree, as its movement is initiated.

The stationary carrier 114 also has a ring 114*a* that extends about the outside of the tube 106, and has a follower 114*b* that is fixed to the ring 114*a*, and extends through the opening 108 and into the interior of the tube 106. The follower 114*b* has a central plate portion 114*c* and a carrier post 114*d* formed in one piece with the central plate portion 114*c*. Aa pair of guide wheels 132, 134 are rotatably connected to the plate portion 114*c*, preferably in a manner such that the guide wheels 132, 134 are located inside the tube and are freely rotatable about a common axis. The traverse cord 116 extends about the guide wheels 132, 134, in a manner known to those in the art, such that the portion of the traverse cord 116 that extends downward from and out of the tube 106 can be used to manipulate the moveable carriers, to thereby move the moveable carriers and the hanging object along the span of the tube.

The follower 114*b* of the stationary carrier is fixedly coupled to the track, by a coupling bracket 150 shown in FIGS. 17, 18. The coupling bracket 150 has a pair of parallel walls 152, 154, and a connecting wall 156. As can be seen in FIGS. 17, 18, the walls 152, 154 are of different lengths, and wall 154 has openings 158 in which stops in the form of rivets or other members can be disposed. As seen from FIGS. 5, 17 and 18, the spacing between the walls 152, 154, and the resilience of the coupling bracket 150 enables the coupling bracket 150 to be resiliently clipped over the plate 114*c* of the stationary carrier and the track 128 (i.e. the track is captured in the gap between wall 154 and central place 114*c*), to secure the stationary carrier 114 to the track. The stops that are located in the openings 158 in the coupling bracket are designed to maintain the coupling bracket 150 in a predetermined location in the tube, so that it does not interfere with the traverse cord that is inserted into the tube.

The lead carrier 112 has a connecting portion disposed inside the tube 106, and designed to engage the traverse cord 116, to enable the traverse cord to maneuver the lead carrier 112. Specifically, the lead carrier 112 has a connecting portion 140 that is shaped like a hook or post, and is fixed to the follower 112*a*, inside the tube (preferably, the portion 140 is formed on the central plate 112*e* of the lead carrier). The connecting portion 140 is configured such that the traverse cord 116 can be tied about the connecting portion, or otherwise fixed to the connecting portion 140. Thus, when the traverse cord 116 is being connected with the traverse rod, the portion of the traverse cord that is guided over the guide wheels 132, 134 can be tied to the connecting portion 140. FIG. 22 schematically illustrates a traverse cord 116 tied to a single lead carrier (e.g. at a single point labeled "X" in FIG. 22). If a single traverse cord is used to maneuver a traverse rod with a pair of lead carriers, the traverse cord 116 can be tied or otherwise connected to the connecting portions of both lead carriers and the traverse cord can then be used to maneuver both lead carriers.

FIG. 23 schematically illustrates a traverse cord connected to a pair of lead carriers (at respective points labeled "X" in FIG. 23). Therefore, by pulling on one portion of the traverse cord 116, the lead carrier (or lead carriers) can be pulled in one direction 104, and by pulling on the other portion of the traverse cord, the lead carrier (or carriers) can be pulled in the opposite direction, thereby providing the traverse rod with the capability to be pulled in either of the directions 104 along the span of the rod 106. Also, as can be seen from FIGS. 22, 23, there are preferably stationary carriers, with guide wheels 132, 134, at each end of the rod, so that the traverse cord 116 is guided by the guide wheels at both ends of the traverse rod. The lead carrier 112 has an arm 129 located at the bottom of the lead carrier ring 112*a*, and can be offset to allow opposing lead carrier arms to pass next to each other when opposing lead carriers are both maneuvered toward and away from each other during a two way draw. The offset is similar to what is shown and described below in connection with FIG. 30*b*.

The end cap 118 is shown in FIGS. 19–21. It comprises an end plate 118*a* and a sleeve 118*b* fixed to the end plate 118*a*. The sleeve has an opening 118*c* that provides the end cap with some resilience an enables the end cap 118 to be tightly fitted over an end of the tube and to maintain itself on the tube (the end cap can also be screw anchored on the tube). The end cap also has traverse cord openings 118*d, e* in the sleeve that enable the traverse cord to extend into the tube (and the ends of the tube have respective openings with which the sleeve openings can be aligned to enable the traverse cord to be inserted into the tube).

The end finials 120 can be of various shapes, styles and colors, to provide aesthetic characteristics to the traverse rod. The end finials are preferably metal, and can be welded or otherwise fixed to the end plates 118*a* of the end caps 118.

In assembling a traverse rod, according to the invention, the track 128 can be initially formed, by welding the connecting pieces 128*c* to the track sections 128*a, b*, to set the gap 130 and to form the internal track. The track can be connected to the interior of the tube 106, by welding the upper track section 128*a* to the interior of the tube, adjacent to the opening 108 in the tube. The moveable carriers 110, 112 can be formed as subassemblies, by connecting the roller bearings 110*d*, 112*d* to the followers 110*b*, 112*b* and by connecting the followers 110*b*, 112*b* to the inside of the rings 110*a*, 112*a*. The moveable carrier subassemblies can then be inserted into the tube through an end of the tube such that the roller bearings are disposed in the gap 130 and will roll along the track. Similarly, the stationary carrier 114 can be formed as a subassembly outside the tube 106, by connecting the guide wheels 132. 134 to the central plate 114*c* of the carrier, coupling the connecting bracket 150, and inserting the subassembly through an end of the tube, and fixing the subassembly to the track, e.g. by using the connecting bracket 150 to connect the stationary carrier subassembly to a portion of the track 128. Once the stationary and moveable carriers have been located in the interior of the tube, the end cap 118 can be inserted over the tube. The end cap can be dimensioned to be press fit onto the end of the tube, or can be otherwise fastened to the tube. Also, an end finial 120 can be attached to the end cap, e.g. before the end cap is connected to the tube, to provide a decorative end to the traverse rod.

The traverse cord 116 is inserted through appropriate openings 118*d*, 118*e* in the end cap, and is guided over the appropriate guide wheels 132, 134, and tied to appropriate connecting portions 140 of the lead carrier 112, to enable the lead carrier to be maneuvered along the span of the tube. As described above, the end cap and tube have respective openings that are aligned to enable the traverse cord to be inserted into and out of the tube and over the guide wheels 132, 134. Also, as described above, the stops on the coupling brackets 150 that couple the stationary carriers to the track are designed to position the coupling brackets so that they do not interfere with movement of the traverse cord when it is maneuvering a hanging object. Additionally, the traverse cord 116 is tied or affixed to a lead carrier or carriers depending on whether the traverse cord is intended to provide a one way draw movement (FIG. 22) or two way draw movement (FIG. 23). Thus, if a hanging object is formed by a pair of hanging sections that are drawn toward and away from each other to open and close an opening such as a window (i.e. a two way draw as shown in FIG. 23), each hanging section would be suspended from a group of moveable carriers, and each group of moveable carriers would include a lead carrier and one or more moveable carriers. The traverse cord would be guided over the guide wheels 132, 134 of the stationary carrier(s) 114, and would be fixed to appropriate connection points on both lead carriers, such that when one strand of the traverse cord is pulled the lead carriers move toward each other, and when the other strand of the traverse cord is pulled the lead carriers are moved away from each other. Thus, the hanging object can be opened and closed, in a manner well known to those in the art. Also, if guide wheels are useful at both ends of the traverse rod, to assure proper movement of the traverse cord, stationary carriers can be located both ends of the traverse rod.

The connecting chain 124 is designed to connect adjacent carriers, and to enable the maximum spacing between adjacent carriers to be selectively controlled. The connecting chain 124 has ball portions 162 that can be pulled through appropriate openings 164 in the carrier rings 110*a*, 112, 114*a*. In order to set the maximum spacing between the carriers, the carrier rings 110*a*, 112*a*, 114*a* would be pinched in the direction shown by arrows 166, to deform the openings and capture a selected ball portion 162 in the carrier ring opening 164. This selectively fixes the maximum spacing between adjacent carriers. Thus, the maximum spacing between adjacent carriers can be set as the lead carrier is pulled in one direction, and the flexibility of the connecting chain 124 enables the moveable carriers to be moved into relatively close proximity to each other as the lead carrier is pulled in the opposite direction.

In some instances, the connecting chain 124 can be dispensed with, and the hanging object effectively becomes the connecting piece that connects adjacent carriers, and enables movement of the hanging object to take place a long the span of the tube.

A traverse rod according to the principles of the present invention can be suspended from a wall and/or a ceiling in various ways. For example, as shown in FIGS. 24, 25, a wall bracket 168 can have one or more upward opening "U" shaped portions 169, each of which can receive and support part of the tube of a traverse rod. In addition, as shown in FIGS. 26, 27, a ceiling bracket 163 can also have one or more "U" shaped portions 165 that can support a portion of a traverse rod. The number and locations of wall and/or ceiling brackets can be determined based on factors such as the available places for supporting the traverse rod and the locations at which the traverse rod needs to be supported, to provide appropriate coverage from the hanging object.

An alternative version of a traverse rod, according to the principles of the present invention is illustrated in FIGS. 28–33. The alternative version of traverse rod, which may be referred to as a pendulum type version, or pendulum for short, has a tube 170 and internal track 172 that are generally similar to the tube and track of the previous embodiment, and moveable and stationary carriers that, rather than extending upward and outward to rings that extend about the tube, are configured to extend downward and outward of the tube. The tube 170 has a longitudinal opening at its lower end that is similar to the opening 108 of the previous embodiment. The track 172 comprises spaced track sections 172*a*, 172*b* that are coplanar and have a gap 173. The lower track section 172*a* is fixed to the inside of the tube (e.g. adjacent the lower opening in the tube). The track sections 172*a*, 172*b* are connected and are maintained in the spaced relationship illustrated by connecting piece(s) 172*c* in a manner similar to the previous embodiment. In the embodiment of FIGS. 28–33, moveable and stationary carriers are provided.

Moveable carriers 176 and 178 are shown in FIGS. 29–32 and have followers (e.g. followers 180, 182) that extend upward from connections 184 for the hanging object, and into the interior of the tube 170. The followers are similar to those of the previous embodiment (except there are no rings outside the tube, and the height of the followers is greater than with the previous embodiment, e.g. by about ¾", because the followers themselves provide the spacing or clearance between the tube and the hanging object). Roller bearings (e.g. roller bearings 190, 192) are connected to the followers and are located partially in the gap 172, so that they roll along the interior track in a manner similar to the previous embodiment. The roller bearings preferably include a pair of roller bearings 192 connected to the a central plate of the lead follower (FIGS. 29, 30*a*, 30*b*) and single roller bearings 190 connected to a central plate of the other followers (FIGS. 31, 32). The roller bearings are located in the gap in the track sections and are connected with both the upper and lower each track section, as with the previous embodiment. The lead carrier 176 has connection points (e.g. connection finger 194), inside the tube, for the traverse cord. Also, the lead carrier 176 has an arm 196 that has a connection point 198 for a hanging object. As seen if FIG. 30*b*, the arm 196 can be offset, to allow opposing lead carrier arms to pass next to each other when opposing lead carriers are both maneuvered toward and away from each other during a two way draw. A stationary carrier has a pair of guide wheels inside the tube, and a carrier post and connecting bracket arrangement that couple the stationary carrier at an end of the tube, as with the previous embodiment.

This embodiment would also have end caps and can also have end finials that are generally similar to the previous embodiment. However, as shown by FIGS. 33*a*–*c*, the end cap 200 is oriented with its opening 210 toward the bottom of the rod, and the end cap has a single hole 202 (rather than the two holes shown in the end cap 118 for the previous embodiment) since the lower opening 210 can function as the other hole for the traverse cord. The hanging object is hung from the connections on the carriers, and the hanging object also serves as the connection between adjacent carriers, as described in connection with the previous embodiment.

Thus, as seen from the foregoing description, a traverse rod according to the present invention comprises; (a) a longitudinally extending tube having an opening extending along the tube, (b) a longitudinally extending track located within the tube, the track comprising a pair of substantially co-planar track sections with a gap therebetween, and (c) one or more moveable carriers each of which is configured to engage a wall covering. Moreover, each moveable carrier has a follower extending through the opening in the tube having a first portion located at least partially in the gap in the pair of track sections and engaging the pair of substantially co-planar track sections such that the follower can ride along the track, so that the moveable carrier can be selectively moved along the tube.

In the embodiment shown in FIGS. 1–21 each moveable carrier comprises a ring configured to extend about the outside of the tube and includes a top portion to which the follower is attached. The opening in the tube is located in an upper portion of the tube, and the follower includes a second portion that extends downward through the opening in the tube and is connected with the first portion of the follower. The first portion of the follower comprises a roller bearing that is located at least partially in the gap in the pair of track sections and engages the pair of track sections, to enable the moveable carrier to roll along the pair of track sections. The follower preferably comprises a plurality of roller bearings, each of which is located at least partially in the gap in the pair of track sections and engages the pair of track sections, to enable the moveable carrier to roll along the pair of track sections. This feature balances the weight distribution on the follower, and minimizes the likelihood of the carrier tipping or tilting as the carriers are moving along the track, even under the weight of the hanging object.

In the modified version of the traverse rod, shown in FIGS. 28–32, the opening in the tube is located in a lower portion of the tube, and the follower includes a second portion that extends upward through the opening and is connected with the first portion of the follower. The first portion of the follower has a roller bearing that is located at least partially in the gap in the pair of track sections and engages the pair of track sections, to enable the moveable carrier to roll along the pair of track sections.

In each preferred embodiment, one of the pair of track sections is fixed to the tube and the pair of track sections are connected to each other by one or more supports fixed to the pair of track members, to maintain the gap at a predetermined distance.

Also, in each preferred embodiment, including a stationary carrier comprising a first portion extends at least partially into the tube, and has at least one guide wheel about which a traverse cord can move, so that the lead carrier can be selectively manipulated relative to the stationary carrier, and the lead carrier is configured so that a traverse cord can be fixedly connected thereto, so that the lead carrier and the traverse cord can be moved together relative to the stationary carrier. Moreover, each carrier is connected with an adjacent carrier (e.g. by a connecting chain or by a hanging object) that sets the maximum spacing between adjacent carriers.

Finally, it is preferred that the main components of the traverse rod are formed of metal, to maintain strength in the traverse rod, while the configuration of the traverse rod is designed to enable smooth and efficient movement of a hanging object supported by the traverse rod, while minimizing the likelihood of damaging the aesthetics of the traverse rod.

Also, while steel is currently preferred, it is contemplated that other metals, composites or plastic materials could also be used for various components. For example, the roller bearings, and/or carriers could be made of plastic. The track could be made of other metals, e.g. aluminum, copper, etc. Moreover, if composites exist or can be made that have strength comparable to steel, the tube could be made of such composites. Additionally, it may be possible to form the tube of other metals (e.g. aluminum, copper, brass) to take advantage of the aesthetics of those metals, provided those metals can provide a tube with the strength necessary to support the various components of the traverse rod.

Current Structural and Aesthetic Preferences for Full Circle Ring (FIGS. 1–21 and Exhibits A–E) and Pendulum Style (FIGS. 28–32) Traverse Rods are Described Below Rod/Track for Full Metal Ring Carriers The shape of the rod can be made out of minimum of 2-inch OD round or square tubing to the suggested maximum of 4 inch OD round or square tubing. Wall thickness of 16 gauge, remains the same on all diameter tubing being used. (At the time, if smaller bearing wheels can be found or made with good load weight factor, the minimum size could at that time go smaller then a 2 inch OD diameter.)

The illustrations and Exhibits are intended to depict a 2-inch OD rod (tubing) and 3-inch OD ring.

The rod has a ⅜$^{th}$ inch opening extending longitudinally along the length of the tube at the top of the tube. By ⅜$^{th}$ inch, applicants mean the width of the opening when viewed in plan view from the top of the tube (see e.g. FIG. 6). This opening allows the roller bearings to ride inside the track and the ring that is attached by a carrier post to the roller bearing to pass through the tube to the outside of the rod and carry the drapery or other hanging object.

Track

Inside of the tube, on the front side of the ⅜ths opening, the track extends the length of the tube and comprises several lengths of ⅛×½ inch flat steel bar. The flat bars are co-planar, positioned one member above the other, vertically, and are fixedly maintained at a distance of 11/16$^{th}$ of an inch between them, to form a gap for the roller bearings to travel back and forth on. Track is tack welded on the inside of the tube and tacked to the ⅜ths of an inch opening at the top of the tube.

There are supports or braces that are made out of a flat bar of ⅛$^{th}$×½ inches bent at 1" radius. Each of these braces is then welded on top and bottom of the lengths of flat bar that form the track. The braces a re placed every 8 inches apart, starting 1 to 2 inches from the ends of the track. These braces hold the top and bottom track 11/16ths apart, thereby maintaining the gap in which the wheels are located, as the wheels roll on the track.

There are bottom support clips along the bottom of the track that are spaced apart every 24 inches. They are made to be tack welded to the bottom track at an ⅛"×⅛" notch and their lower ends are configured to rest on the inside of the tube when weight is added to the track (e.g. by a hanging object and the carriers supported on the track)

Full Circle Metal Rings

Full circle metal rings are fabricated out of 3/16ths or ¼ inch cold rolled round rod or square rod (rings can be round or square shape). They are then cut into appropriate lengths, bent into circle or square and tack welded onto carrier post. Full circle metal rings or square shaped rings should be at least 1-inch larger in diameter then the tubular OD metal rod size being used. This enables the rings to pass freely on the tube.

For illustration purposes a circular full circle metal ring is 3-inches OD for a 2-inch outer diameter metal tube.

On a full circle metal ring a smaller full circle metal ring is placed that is ¾ inch outside diameter. This ring is supported on and can move around the larger full circle ring. The smaller metal ring automatically positions itself at the bottom of the large full circle ring to hold e.g. a drapery pin of a drape or another connector for a hanging object.

A ⅛" hole is drilled ¼" to rear of carrier attachment on the full circle rings, for the metal centering chain to pass through, to set the maximum spacing for adjacent the full circle rings. In most cases, in the applicants' experience, the metal connecting chain is likely to be configured to allow adjacent full circle metal rings to have a maximum spacing of about 3½ " to 5 inches apart (but that will generally also be a decorator's decision).

Steel plate for a carrier post is ⅛"×1⅛ " wide×2" height, with a 3/16$^{th}$ hole in center of the plate, and the width of the steel plate is tapered to ¼", to form the carrier post for a full circle ring, with the tapered portion configured for attachment to a full circle ring, and to fit in the ⅜ths" opening at the top of the metal tube.

Metal bearing wheels (e.g. for a lead or other carrier) are one inch outside diameter. The bearing is ½ of an inch in the center of the wheel. In the center of the bearing is a 3/16ths hole. This is where a rivet goes to attach wheel to carrier post steel plate. The metal wheel bearing has a load capacity of maximum 20 pounds.

One single bearing metal wheel is used for a carrier other than a lead carrier and stationary carrier, flat steel plate is used, and the plate is tapered to ¼" and the end of the steel plate is tack welded to the full circle metal ring.

The metal full ring carrier is tack welded to the flat steel tapered end of the carrier post and wheels are positioned straight down from the top, and when looking at ring they are inside the diameter of the ring. This way when the carrier ring is disposed around the metal tube, the metal ring carrier fits through the ⅜ths cut out and the wheels set between the 2 internal co planar track sections that are spaced 11/16ths" apart, and tack welded to the ⅜ths inch opening of the tube. The ¾ inch small ring that is around the large ring automatically floats to bottom of ring, where the drapery pin fits into it.

The Lead Carrier Full Circle Ring

Rings are fabricated out of 3/16ths or ¼ inch cold rolled round rod or square rod (rings can be round or square shape). Then cut into appropriate lengths and tack welded. Rings should be at least 1-inch larger in diameter then the OD rod size that being used (or in the case of square rings, with at least 1 inch total clearance from the OD of the tube. This enables the rings to pass freely on the rod.

A ⅛" hole is drilled ¼" to rear of carrier attachment for the centering chain to pass through, to set the maximum spacing for an adjacent carrier. In applicants' experience, in most cases the decorator will want the rings to be about 3½" to 5 inches apart.

For illustration purposes the full metal ring here is 3-inches for a 2-inch outer diameter tube.

The lead Carrier ring is the exact same size as the other carrier rings. The carrier post for the lead carrier ring has two metal bearing wheels, to minimize the likelihood of tilting of the lead carrier when movement of the lead carrier (with a connected hanging object) is initiated.

Metal bearing wheels are each one inch outside diameter. The bearing is ½ of an inch in the center of the wheel in the center of the bearing is a 3/16ths hole. This is where the rivet goes to attach wheel to steel plate. Each metal wheel bearing has a load capacity of maximum 20 pounds.

Steel plate for a carrier post for a lead carrier is ⅛"× 2¼" wide×2" height, with 2 holes 5/32$^{nd}$ drilled in steel plate (as with the other carrier posts, the width of the steel plate is tapered to ¼", to enable the carrier post to fit through the ⅜$^{th}$ inch opening in the top of the tube. 2 holes are drilled equal distance from the center and bottom of plate, which is 9/16ths each direction from center of plate width. At these locations the bearing wheels are attached with rivets on to the steel plate, so there is ⅛$^{th}$ inch between wheels. On steel plate ⅛×⅝" there is a push out finger which is located ½" from the bottom of the carrier post. A traverse cord can be attached to the push out finger or other attachment point on the lead carrier.

On the full circle lead carrier metal ring, a ¾ inch diameter ring is placed, made out of 3/16$^{th}$ flat or round rod (this ring can move freely about the lead carrier, and hangs at bottom of large ring). Additionally, the bottom of the lead carrier ring a ¼"×3½ inch horizontal bar is tack welded ⅜" off center to the right. The bar runs horizontally off the lead carrier ring. On the end of the 3½ inch horizontal bar a hole is drilled to receive the end drapery hook. The horizontal bar can be square or round shape. The horizontal bar forms an arm that can be offset, to allow the a rms of opposing lead carriers to pass next to each other during a two way draw.

The lead carrier holds the end pleat of the drapery and end of the overlap.

On a one-way rod (drape stacks only to one side) there is one lead carrier ring.

On a two-way rod (the drape stacks on both sides) there are two lead carrier rings.

Stationary Full Circle Metal Ring

At the end of each rod there is a stationary full circle metal ring. It comprises a full circle metal ring that is attached to a single wheel carrier post, at which a pair of wheels are attached to a single axle to form a pair of guide wheels, and a end bearing carrier bracket attaches the carrier post to the track. This end bearing bracket carrier fits at the end of the track on each end. The wheels are located on the outside of track and are used as guide wheels for traverse cord guidance travel.

The end bearing bracket is configured with stop holes that can receive a rivet that forms a stop, to prevent the bracket from pinching the traverse cord to the tube when the traverse cord is pulled.

The bracket is snapped tightly on to the track inside the tube. The bracket on this end of the track also acts as a traverse cord guidance travel system.

Traverse Cord for Full Circle Metal Ring

The cord is a #4 cord, nylon cord w/fiberglass core. It can be purchased either from Kirsch or Graber.

For a single lead carrier the traverse cord runs from the lead carrier around the inside of the rod, extends about the guide wheels at both ends, drops through one of the end caps for a right or left hand traverse pull, and extends back to the lead carrier and is tied off.

For a double lead carrier the cord goes from 1 lead carrier around the inside of the rod, about the guide wheels at both ends, drops through one of the end caps for a right or left hand traverse pull, extends back to the other lead carrier and is tied off. Either way the cord makes a complete circle.

End Caps for Full Circle Metal Ring

The end caps are made out of 1/16$^{th}$ gauge material. The diameter of the cap is 11/16ths larger then the tube. This enables the cap to be eased on to the ends of the rod. The caps are 1½ " inches in length; this enables the cap to be slipped over the ends of the tube. Each end cap has a slit cut out of the metal that is ⅜ths wide×1½ inch long. This slit is positioned at the top of the tube.

The end caps fit over the ends of the tube. In each end cap at the bottom there are 2 holes drilled (with rubber ring to fit over metal edges so traverse cord will not fray against metal edges) that allows the traverse cord to drop through. Thus, it is a matter of choice as to whether the traverse cord can be used on the right or left side of the rod, to operate the draperies open or shut. This enables a person to pull on the cord and open and shut the drapes easily, without having to touch the drapery fabric and pull it across the window.

Metal Wall Brackets for a Single Tubular Rod for Full Circle Rings and or Pendulum Carriers (Same Wall Brackets for Full Circle Metal Rings or Pendulum Carrier)

The wall brackets are made of ⅛ inch×¾ inch flat bar. Each wall bracket is formed to fit the individual rod size that is used for a particular project. The leg of the wall bracket (that is attached to the wall when installed) is 18 inches for the outside brackets that hold the rod on each end. When a center support is required on a two-way stack, that support bracket leg is 12 inches in height.

From the leg of the wall bracket which will be attached to the wall the flat bar is welded horizontally, a pocket is formed, center of pocket is 3" from wall bracket leg. Pocket is formed to match rod/tube size and style being used. Pocket is ½ the diameter width of rod/tube for depth of pocket, width of pocket is same as diameter of rod/tube being used (all measurements are based on OD of rod/tube being used).

A diagonal support bar ⅛"×½" is welded on the inside edge, 3" down on the vertical bracket leg and to the back side of the U shaped portion, on the opposite edge. A ¾" ring is tack welded to the vertical bracket leg, to enable a drapery pin to be connected thereto.

The $3/16^{th}$ hole is placed in the center of pocket to allow for rod/tubing attachment with a #10-24 screw.

Metal Wall Brackets for 2 Tubular Rods with Full Circle Rings and/or Pendulum Carrier (Same wall brackets for full circle metal rings or pendulum carrier)

The wall brackets are made of ⅛th×*frax*;¾ inch flat bar. Each wall bracket is formed to fit the individual rod size that is used for a particular project. The leg of the wall bracket (that is attached to the wall when installed) is 18 inches for the outside brackets that hold the rod on each end. When a center support is required on a two-way stack, the support bracket leg is 12 inches.

From the leg of the wall bracket which will be attached to the wall the flat bar is welded horizontally, a pocket is formed, center of pocket is 3" from wall bracket leg. Bar continues horizontally where a second pocket is formed, 3⅞" from center of $1^{st}$ pocket. Pockets are formed to match rod/tube size and style being used. Each pocket is ½ the diameter width of rod/tube for depth of pocket, width of pocket is same as diameter of rod/tube being used (all measurements are based on OD of rod/tube being used).

A diagonal support bar ⅛"×½" is welded on the inside edge, 3" down on the vertical bracket leg and to the back side of the U shaped portion, on the opposite edge. A ¾" ring is tack welded to the vertical bracket leg, to enable a drapery pin to be connected thereto.

The $3/16^{th}$ hole is placed in the center of pocket to allow for rod/tubing attachment with a #10-24 screw.

Tubular Rod with Pendulum

Under-sheer Tubular Rod (Tubular Rod that is used with internal track that carries the rings. This rod is closest to the window wall and has no need for the rings on this tubular rod, because the outside tubular rod has full circular rings for the decorative look that a customer would want.) This tubular rod needs to go with the tubular rod with full circle rings because then the texture and color of the rods can be matched. The brackets are custom made also that way the brackets indentation where the rods sit and the top plate will fit both rods properly. In most insistence this rod would be used as the under drapery rod (normally called the under-sheer rod).

The shape of the rod can be made out of minimum of 2-inch round or square tubing to the suggested maximum of 4 inch round or square tubing. Wall thickness of 16th gauge, remains the same on all tubing being used. (If smaller bearing wheels, with good load weight factor, are found, the minimum size could at that time go smaller then a 2" diameter)

Tubular Rod for pendulum is the same (as on full ring tubular rod) except for the cut opening is turned and positioned to the bottom of tube.

Internal Track for Pendulum Carrier

Internal track for pendulum carrier is attached to the tubular rod, exactly the same (as on full ring tubular rod) except for the cut opening is turned and positioned to the bottom of tube.

Pendulum Carrier

Pendulum carrier is the same (as on full ring carriers) except it does not have a full circle ring or a connection ring and is ¾" taller than the carrier for a full circle ring. The dimensions of the pendulum are 2¾"×1⅛"×⅛" flat steel. A 5/32" hole is drilled at the bottom of the tapered ¼" carrier post and then pendulum carrier hangs through ⅜ths" cut of tubular rod that is positioned at bottom of tubular rod.

Pendulum Lead Carrier

Lead carrier for pendulum is the same (as full ring lead carrier) except there is no full circle ring and no connection ring, and the carrier is ¾" taller than full ring carrier with a 3½ " arm at the bottom. Holes are drilled at the bottom of the tapered ¼" carrier post and arm. The arm can be offset, e.g. by a ⅜" offset, to allow the arms of opposing lead carriers to pass next to each other during a two way draw.

The pendulum carrier hangs through ⅜ths" cut of tubular rod that is positioned at bottom of tubular rod.

On a one-way rod (drape stacks only to one side) there is one lead carrier ring.

On a two-way rod (the drape stacks on both sides) there are two lead carrier rings.

Stationary Pendulum Carrier

At the end of each rod/tubing and track there is a stationary pendulum carrier.

A stationary pendulum carrier has a pendulum carrier post, with guide wheel wheels and an end bearing bracket carrier that attaches the stationary pendulum to the track. This end bearing bracket fits at the end of the track on each end. Wheels are set on the outside of track and are used for traverse cord guidance travel.

An end bearing bracket is configured to prevent bracket from pinching the traverse cord when the traverse cord is pulled.

The end bearing bracket is snapped tightly on to the track inside the tube, to couple the stationary carrier post to the track. The wheels on the stationary carrier post act as a traverse cord guidance travel system.

Traverse Cord for Pendulum

The cord is a #4 cord, nylon cord w/fiberglass core. It can be purchased either from Kirsch or Graber.

For a single lead carrier the traverse cord runs from the lead carrier around the guide wheels at both ends of the rod. The cord drops through one of the end caps for a right or left hand traverse pull, back to the lead carrier and is tied off.

For double lead carrier the cord goes from 1 lead carrier around the inside of the rod and around the guide wheels at both ends of the rod. The cord drops through one of the end caps for a right or left hand traverse pull, back to the other lead carrier and is tied off. Either way the cord makes a complete circle.

End Caps for Pendulum

The end caps are made out of $1/16^{ths}$ gauge material. The diameter of the cap is $1/16^{ths}$ larger then the tube. This enables the cap to be eased on to the ends of the rod. The caps are 1½ " inches in length; this enables the cap to be slipped over the ends of the tube. Each end cap has a slit cut out of the metal that is ⅜ths wide×1½ inch long. This slit is positioned at the bottom of the tube.

The end caps fit over the ends of the tube. In each end cap at the bottom there is a hole drilled (with rubber ring to fit over metal edges so traverse cord will not fray against metal edges) that allows the traverse cord to drop through. Thus, it is a matter of choice as to whether the traverse cord can be used on the right or left side of the rod, to operate the draperies open or shut. This enables a person to pull on the cord and open and shut the drapes easily, without having to touch the drapery fabric and pull it across the window.

Metal Wall Brackets for a Single Tubular Rod for Full Circle Rings and or Pendulum Carrier (Same Wall Brackets for Full Circle Metal Rings or Pendulum Carrier)

The wall brackets are made of ⅛thx¾ inch flat bar. It is formed to fit that individual rod size, that are required for that job. The leg of the wall bracket (that is attached to the wall when installed) is 18 inches for the outside brackets that hold the rod on each end. When a center support is required on a two-way stack, that support bracket leg is 12 inches in height.

From the leg of the wall bracket which will be attached to the wall the flat bar is welded horizontally, a pocket is formed, center of pocket is 3" from wall bracket leg. Pocket is formed to match rod/tubing size and style being used. Pocket is ½ the diameter width of rod/tubing for depth of pocket, width of pocket is same as diameter of rod/tubing being used (all measurements are based on OD of rod/tubing being used).

A diagonal support bar ⅛"x½" is welded on the inside edge, 3" down on the vertical bracket leg and to the back side of the U shaped portion, on the opposite edge. A ¾" ring is tack welded to the vertical bracket leg, to enable a drapery pin to be connected thereto.

The $3/16^{th}$ hole is placed in the center of pocket to allow for rod/tubing attachment with a #10-24 screw.

Metal Wall Brackets for Tubular 2 Rods Full Circle Rings and/or Pendulum Carriers (Same Wall Brackets for Full Circle Metal Rings or Pendulum Carriers)

A wall bracket is made of ⅜thsx¾ inch flat bar. It is formed to fit that individual rod size, that are required for that job. The leg of the wall bracket (that is attached to the wall when installed) is 18 inches for the outside brackets that hold the rod on each end. When a center support is required on a two-way stack, the support bracket leg is 12 inches.

From the leg of the wall bracket which will be attached to the wall the flat bar is welded horizontally, a pocket is formed, center of pocket is 3" from wall bracket leg. Bar continues horizontally where a second pocket is formed, 3⅞" from center of $1^{st}$ pocket. Pockets are formed to match rod/tubing size and style being used. Pocket is ½ the diameter width of rod/tubing for depth of pocket, width of pocket is same as diameter of rod/tubing being used (all measurements are based on OD of rod/tubing being used).

A diagonal support bar ⅛"x½" is welded on the inside edge, 3" down on the vertical bracket leg and to the back side of the U shaped portion, on the opposite edge. A ¾" ring is tack welded to the vertical bracket leg, to enable a drapery pin to be connected thereto.

The $3/16^{th}$ hole is placed in the center of pocket to allow for rod/tubing attachment with a #10-24 screw.

Ceiling Mount Bracket for Single Roller Track Rods and for Pendulum Application

The bracket is U shaped at the top of the U the legs are 4 inches long, on each side. On each leg there are three drilled holes of 3/16ths, spaced 2 inches apart. These holes are where the screws will go to attach the U shape bracket to ceiling.

The U-bracket is made out of ⅛thx¾ inch flat bar. The leg is 4 inches then the flat bar is bent deep enough to allow the diameter of the rod being used to fit in U-bracket tightly. The stirrup after being bent then will have another leg bent horizontally. The horizontal portions of the U-bracket are attached to the ceiling.

Ceiling Mount Bracket for Single Track Rods Application

The bracket is U shaped at the top of the U the legs are 4 inches long, on each side. On each leg there are three drilled holes of 3/16ths, spaced 2 inches apart. These holes are where the screws will go to attach the U shape bracket to ceiling.

The U-bracket is made out of ⅛thx¾ inch flat bar. The leg is 4 inches then the flat bar is bent deep enough to allow the diameter of the rod being used and the top of the rings to move freely without rubbing ceiling, the formed pocket should be ¾" deeper then rod pocket that is being formed. The rod should fit in U-bracket tightly, but leave enough room at top for the free motion of the rings. The U-bracket after being bent then will have another leg bent horizontally. The horizontal portions of the U-bracket are attached to the ceiling.

End Finials for All Rods

The end caps can be used with or without a decorative finial on the end. The end finials can be custom made to any ones order. They also, can be a pre-cast metal decoration. The end finial or no finial is all up to the customer's request, of the look that the customer wants to achieve.

The finial would be tack welded to end of end cap.

Color and Textures for All Rods

Color of rods and texture of rods again is open to customers request. They can be painted, weathered look, spray texture-what ever the customers little heart desires.

Thus, it will be apparent to those in the art that the traverse rod of the present invention has a number of Unique Features; Specifically, the hollow metal tubular rod handles weight well. The metal track is internal to the tube, and is not visible when the rod is in use. The preferred versions of the traverse rod are designed for high load capacity. No center supports are needed for traverse rods of significant span, e.g. up to 12 feet, and only one center support needed for significantly longer spans, e.g. 12 feet to 24 feet. The traverse rod itself is designed to be aesthetically pleasing, and is also designed to support and enable efficient manipulation of a hanging object a long the span of the rod, with low friction, minimum side load, and in a manner that minimizes risk of wear and other conditions that can spoil the aesthetics of the rod.

The invention claimed is:

1. A traverse rod comprising a. A longitudinally extending tube having an opening extending along the tube, b. A longitudinally extending track located inside the tube, the track comprising a pair of substantially co-planar track sections located inside the tube, the track sections having a gap therebetween, and c. One or more moveable carriers each of which is configured to engage a wall covering;

each moveable carrier having a follower extending through the opening in the tube, the follower having a first portion located inside the tube and at least partially in the gap in the pair of track sections and comprising at least one roller bearing which is located inside the tube and at least partially in the gap in the pair of track sections and engages the pair of track sections such that the follower can ride along the track, whereby the follower and the moveable carrier can be selectively moved along the tube, wherein the opening in the tube is located in an upper portion of the tube, and wherein the follower further includes a second portion that extends downward through the opening in the tube and is connected with the first portion of the follower, wherein each moveable carrier comprises a ring configured to extend about the outside of the tube and includes a top portion to which the follower is attached, wherein each ring comprises a full circle ring that completely encircles the tube, and a stationary carrier comprising a carrier post with a first portion extending at least partially into the tube, the first portion of the stationary carrier including at least one guide wheel about which a traverse cord can be guided, so that the traverse cord can be selectively manipulated relative to the non moveable carrier, and wherein at least one moveable carrier comprises a lead carrier configured such that a traverse cord can be fixedly connected thereto, so that the lead carrier and the traverse cord can be moved together relative to the stationary carrier.

2. The traverse rod of claim 1, including a plurality of moveable carriers, each of which has a follower with a roller bearing that can roll along the track inside the tube, one of the moveable carriers comprising the lead carrier, and each of the moveable carriers being connected with adjacent moveable carriers by a connector that determines the maximum amount of spacing between adjacent carriers.

3. The traverse rod of claim 2, wherein the tube, the moveable and stationary carriers, and the track sections are each formed of metal.

4. The traverse rod of claim 2, wherein the lead carrier has a pair of roller bearings connected with the follower and located in the gap between the track sections, the pair of roller bearings being located relative to the follower in a manner designed to minimize tilting of the lead carrier.

5. The traverse rod of claim 1, wherein the carrier post further includes a second portion that extends into the tube and is coupled to the first portion, and further including a coupling device for coupling the second portion of the carrier post to the track that is inside the tube.

6. The traverse rod of claim 5, wherein the tube has one or more openings configured to receive a traverse cord, and wherein the coupling device is configured to couple the second portion of the carrier post to the track without interfering with the openings in the tube that are configured to receive the traverse cord.

7. The traverse rod of claim 1, wherein the first portion of the stationary carrier includes a plate that is connected with the post, the plate supporting the guide wheel, and wherein a coupling bracket that is clipped over a portion of the plate and a portion of the track forms part of a coupling between the stationary carrier and the track.

8. The traverse rod of claim 1, wherein the tube comprises a metal tube, and the pair of track sections comprise coplanar metal track sections that are located in a vertical plane.

9. The traverse rod of claim 1, wherein the follower of the lead carrier includes a plurality of roller bearings, each of which is located inside the tube and at least partially in the gap in the pair of track sections and engages the pair of track sections such that the follower can ride along the track, whereby the follower and the moveable carrier can be selectively moved along the tube.

* * * * *